US005488463A

United States Patent [19]

Nimura et al.

[11] Patent Number: 5,488,463

[45] Date of Patent: Jan. 30, 1996

[54] IMAGE FORMING APPARATUS TO FORM IMAGES ONTO A SHEET A PLURALITY OF TIMES

[75] Inventors: Mitsuo Nimura, Kawasaki; Kazuhiko Hirooka, Tokyo; Shokyo Koh; Masao Watanabe, both of Kawasaki, all of Japan

[73] Assignee: Canon Kabushiki Kaisha, Tokyo, Japan

[21] Appl. No.: 193,573

[22] Filed: Feb. 7, 1994

[30] Foreign Application Priority Data

Feb. 8, 1993 [JP] Japan ..... 5-041813

[51] Int. Cl.[6] ..... G03G 15/00

[52] U.S. Cl. ..... 355/322; 371/3.15; 371/3.16; 371/3.18; 371/186; 371/242; 371/301; 355/200; 355/308; 355/321

[58] Field of Search ..... 355/308, 309, 355/316, 317, 318, 319, 321, 322, 24, 23, 208, 207; 271/3.1, 225, 301, 65, 186, 242, 3.01, 3.06, 3.09, 3.13, 3.16, 3.18, 3.15

[56] References Cited

U.S. PATENT DOCUMENTS

| | | | |
|---|---|---|---|
| 5,090,674 | 2/1992 | Ozawa | 355/322 X |
| 5,246,224 | 9/1993 | Matsuno et al. | 271/242 |
| 5,305,995 | 4/1994 | Nakajima et al. | 271/3.1 X |

FOREIGN PATENT DOCUMENTS

| | | | |
|---|---|---|---|
| 4-85244 | 3/1992 | Japan | 271/242 |
| 2208852 | 4/1989 | United Kingdom | 271/242 |

*Primary Examiner*—Matthew S. Smith

*Attorney, Agent, or Firm*—Fitzpatrick, Cella, Harper & Scinto

[57] ABSTRACT

An apparatus for forming an image onto a transfer sheet a plurality of times includes an image forming unit for forming an image onto a sheet which is conveyed; first and second conveying units for conveying the sheet from the image forming unit to the image forming unit, wherein the second conveying unit stops the first sheet conveyed by the first conveying unit at a predetermined position and, after the second sheet which is conveyed subsequently to the first sheet conveyed by the first conveying unit was conveyed to a predetermined position on the first sheet, the second conveying unit conveys the first and second sheets in a partially overlapped state and separates the first sheet and supplies the separated first sheet to the image forming unit; and a sheet detecting sensor for detecting the front edge of the sheet which is conveyed by the first conveying unit. After the first sheet was conveyed by the first conveying unit by a first predetermined amount after the front edge of the first sheet had been detected by the sensor, the second conveying unit conveys the first sheet conveyed by the first conveying unit and stops the first sheet at the predetermined position, and after the second sheet was conveyed by the first conveying unit by a second predetermined amount different from the first predetermined amount after the front edge of the second sheet had been detected by the sensor, the second conveying unit conveys the first and second sheets.

29 Claims, 15 Drawing Sheets a a

FIG. 23

⟨NUMBER OF STACKED SHEETS⟩

| | CONVEYING FRACTION DEFECTIVE | LOOP AMOUNT INITIAL VALUE | LOOP AMOUNT ADJUSTING VALUE | |
|---|---|---|---|---|
| 1 | 1/10000 | 10 | ±0 | |
| 2 | 30/5000 | 8 | −2 | K |
| ⋮ | ⋮ | ⋮ | ⋮ | |
| n | 0/2000 | 5 | ±0 | |

FIG. 24

⟨STACKED MODE⟩

| | CONVEYING FRACTION DEFECTIVE | LOOP AMOUNT INITIAL VALUE | LOOP AMOUNT ADJUSTING VALUE | |
|---|---|---|---|---|
| BOTH SIDES | 1/10000 | 10 | ±0 | |
| MULTI-PLICITY | 30/5000 | 8 | +2 | K |

IMAGE FORMING APPARATUS TO FORM IMAGES ONTO A SHEET A PLURALITY OF TIMES

BACKGROUND OF THE INVENTION

1. Field of the Invention

The invention relates to an image forming apparatus in which a sheet on which an image was formed by an image forming section is again fed to the image forming section and images are formed onto the sheet a plurality of times.

2. Related Background Art

Hitherto, a copying apparatus which can form images/image onto both sides or one side of a copy transfer sheet has been put into practical use as a product and the conveyance of the transfer sheet is controlled by various kinds of conveying system.

For instance, in the conveyance control called a setback system, when a transfer sheet on which an image was formed on a conveying path provided on a copying apparatus main body is again fed to an image forming section through a lower conveying path in the apparatus, a plurality of transfer sheets on which images have already been formed and are enclosed onto the lower conveying path are stacked in a stake in which they are partially overlaid each other, thereby preventing that a plurality of transfer sheets are simultaneously conveyed when the transfer sheet is fed from the lower conveying path. Particularly, the setback system makes the most of the effect in the case where an arrangement space of the lower and upper conveying paths is limited in association with a demand to reduce the size of main body.

According to the conventional copying apparatus, an image forming apparatus in which a transfer sheet is conveyed by several rollers comprising different driving means upon formation of an image is constructed in a manner such that the several rollers comprising the different driving means sandwich the transfer sheet and even in case of driving from the stop state, the several rollers comprising the different driving means are simultaneously driven by driving commands of the same timing. When stopping, the driving operations of the different several rollers are also simultaneously stopped by drive stopping commands of the same timing.

In the format case, however, the same operations (namely, the operations such that the transfer sheet is run into the first setback roller on the front side in the conveying direction, a predetermined amount of loop is formed, and after that, the first setback roller is forwardly rotated, the second setback roller on the rear side in the conveying direction is also forwardly rotated, the transfer paper is forwardly moved by a predetermined amount, the first and second setback rollers are reversely rotated, and the transfer sheet is backwardly moved by a predetermined amount and stopped) are continuously repeated every transfer sheet, thereby executing the setback operation. However, in order to operate so as to accurately set a deviation amount of each sheet to a predetermined value, there are the following problems.

(1) After completion of the formation of one image of one surface, since the transfer sheet is conveyed along a long conveying path, the sheet is run into the first setback roller and a relatively large loop is formed and an oblique movement of the sheet must be prevented.

(2) When pressures of the first and second setback rollers to convey the transfer sheet are too large, the image on the first surface formed on the transfer sheet is rubbed with the rollers, the image becomes dirty, and the back side of the transfer sheet becomes dirty. Therefore, the roller pressures cannot be set to large values.

(3) There is a case where in a state in which the first setback roller sandwiches the formar transfer sheet, another transfer sheet runs into the first setback roller and is interposed between the first setback roller and the former transfer sheet upon formation of a loop. Thus, a stacking state is broken and the deviation amount of each sheet which should be constant varies.

(4) In dependence of the number of transfer sheets sandwiches by the first setback roller, a difference occurs in a thrust amount between the first setback roller and the stacked transfer sheet upon formation of a loop, so that the transfer sheet which will be stacked later is stacked in a state in which a deviation amount of each sheet is not constant.

Therefore, when the transfer sheet is again fed from the lower conveying unit to form an image of the second surface, a defective separation of each transfer sheet occurs and a sheet jam occurs.

In the latter case, on the other hand, several rollers comprising the different driving means sandwich the transfer paper and in case of driving from the stop state, the apparatus operates so as to simultaneously drive different several rollers by the driving commands of the same timing. Therefore, there are the following problems.

(1) In the case where a rise time of the driving of the rear side roller is faster than that of the front side roller for the moving direction of the transfer sheet, a loop of the transfer sheet is formed between the front side roller and the rear side roller. Consequently, the transfer sheet is subjected to a damage such as bending, waving, or the like. Further, when the image is copy transferred to the sheet, an image blank portion occurs on the sheet.

(2) In the case where the rise time of the driving of the rear side roller is slower than that of the front side roller for the moving direction of the transfer sheet, the transfer sheet is stretched between the front side roller and the rear side roller, so that the sheet is obliquely moved or a defective conveyance is caused.

(3) In the case where the transfer sheet onto which images have already been copy transferred in the both-sides/multiplex mode or the like, the images on the transfer sheet are rubbed by the rear side roller, so that the images and roller become dirty.

(4) Even in case of stopping the transfer sheet from the drive conveying state, there are various problems such that the transfer sheet is rubbed, the images and roller become dirty, and the like because of an asynchronizing state between both of the roller drive timings.

SUMMARY OF THE INVENTION

It is an object of the present invention to provide an image forming apparatus which can solve the above problems.

Another object of the invention is to provide an image forming apparatus in which a plurality of sheets on which images have once been formed can be held in a stable state and the sheets can be fed to an image forming section in the stable state.

Still another object of the invention is to provide an image forming apparatus in which when a loop is formed in a transfer sheet to be set back, a run-into conveyance amount of the transfer sheet to a paper conveying roller is made variable to thereby enable a loop amount to be varied, a setback operation which can normally separately feed the sheet even when a conveying state of the transfer sheet to be conveyed fluctuates can be realized, and when the conveyance is stopped or started in a state in which the transfer sheet rides over the adjacent paper conveying rollers of different driving sources, driving/stopping timings of the adjacent sheet conveying rollers of the different driving sources are delayed, so that a damage of the transfer sheet at the time of the stop or start of the conveyance can be prevented.

The above and other objects and features of the present invention will become apparent from the following detailed description and the appended claims with reference to the accompanying drawings.

BRIEF DESCRIPTION OF THE DRAWINGS

FIG. 23 is a schematic diagram showing a first adjustment value display example on an operation unit shown in FIG. 2;

FIG. 24 is a schematic diagram showing a second adjustment value display example on the operation unit shown in FIG. 2;

DETAILED DESCRIPTION OF THE PREFERRED EMBODIMENTS

Figure 1:
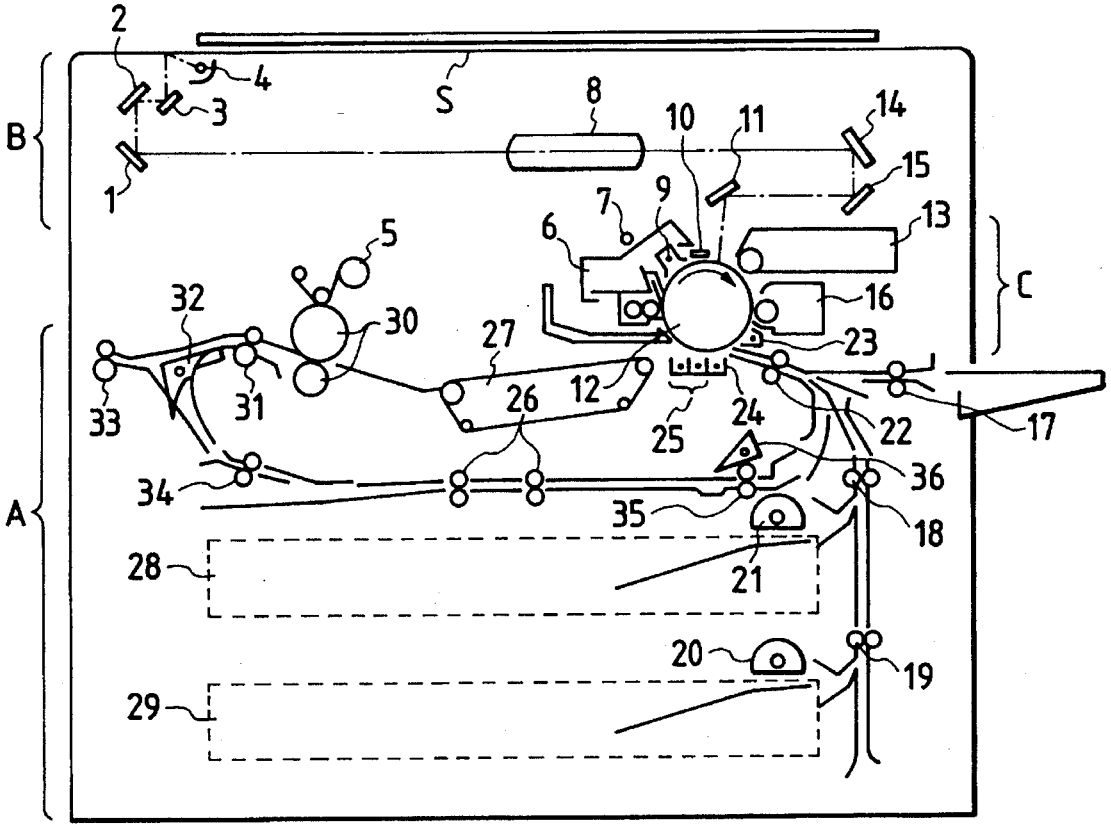
FIG. 1 is a cross sectional view for explaining a construction of a copying apparatus showing an embodiment of the invention.

FIG. 1 is a cross sectional view for explaining a construction of a copying apparatus showing an embodiment of the present invention. The copying apparatus is constructed by a paper feed conveying system A, an exposing system B, an image forming system C, and a control system to execute a well-known electrophotographing process.

The exposing system B comprises: an original supporting plates; an original illuminating lamp 4; mirrors 1 to 3; a zoom lens 8; and mirrors 14, 15, and 11. An original put on the original supporting plate S is scanned by the original illuminating lamp 4, so that a light image of the original is projected onto a photosensitive drum 12 through a plurality of mirrors 1 to 3, zoom lens 8, and mirrors 14, 15, and 11. The scan of the lamp 4 is driven by a stepping motor for optical driving (not shown). The zoom lens 8 is driven by a stepping motor for lens driving (not shown). A magnification of an output image is varied by changing a scanning speed of the original illuminating lamp 4 and by moving the position of the lens motor.

The image forming system C comprises: the photosensitive drum 12; a pre-exposing lamp 7; a primary charging device 9; a blank exposing lamp 10; a first developing device 16; a second developing device 13; a drum cleaning unit 6; and the like. The drum 12 is rotated in the direction shown by an arrow in the diagram. Among the charges on the drum surface which were primarily charged by the primary charging device 9, the charges in the non-image portion are eliminated by the blank exposing lamp 10 and the image is exposed by the projection light of the original from the exposing system. An electrostatic latent image formed on the photosensitive drum 12 by the image exposure is developed by the first developing device 16 or, the second developing device 13 (which is constructed as an exchangeable unit so that a developing color can be changed). After that, the developed image is copy transferred by a transfer charging device 24 onto the transfer sheet conveyed by the paper feed conveying system A.

The remaining toner on the drum 12 after completion of the copy transfer is eliminated by the cleaning unit (drum cleaning unit) 6. Further, the residual charges are discharged by the pre-exposing lamp 7. A process such as primary charging, image exposure, development, and copy transfer is again repeated.

The paper feed conveying system A comprises: cassettes 28 and 29; paper feed rollers 20 and 21; vertical path rollers 18 and 19; a registration roller 22; a conveying belt 27; paper delivery rollers 31 and 33; a setback roller 26; and the like. In the paper feeding operation from the cassette 28, the transfer sheet is picked up and fed out from the cassette 28 by the feed roller 21 and is conveyed to the arranging position of the registration roller 22 by the vertical path roller 18. In the paper feeding operation from the cassette 29, the transfer sheet is picked up and fed out from the cassette 29 by the feed roller 20 and is conveyed to the position of the registration roller 22 by the vertical path rollers 19 and 18. In the paper feeding operation by a hand insertion, the transfer sheet fed by the hand insertion is conveyed to the position of the registration roller 22 by a hand insertion paper feed roller 17.

The transfer sheet conveyed to the registration roller 22 runs into the registration roller 22 and forms a loop, thereby preventing an oblique movement of the sheet or correcting the timing for matching the front edge of the image. In the embodiment, in order to coincide the edge portion in the lateral direction of the image on the drum 12 with the edge portion of the transfer sheet, a control for moving the registration roller 22 in the lateral direction is also executed by a stepping motor (not shown).

The toner image developed on the drum 12 is transferred by the transfer charging device 24 onto the transfer sheet conveyed by the registration roller 22. The transfer sheet is subsequently peeled off from the drum 12 by a separation charging device 25 and passes through the conveying unit 27 and is conveyed to the arranging position of a fixing roller 30. The fixing roller 30 is heated by a fixing heater 311 (which will be explained hereinlater). A temperature of the surface of the fixing roller 30 is detected by a thermistor 302 shown in FIG. 2, thereby controlling the surface temperature of the fixing roller 30 so as to be a predetermined value. The toner image transferred onto the transfer sheet which had been conveyed to the fixing roller 30 is fixed by the fixing roller 30 by a heat and a pressure. The surface of the fixing roller 30 after the toner image was fixed is cleaned by a web 5. In the ordinary copying mode, the transfer sheet on which the toner image was fixed is conveyed by the paper delivery rollers 31 and 33 and is delivered to the outside of the apparatus.

In the multiplex copying mode, a paper deflecting plate (flapper) 32 is directed to the upper side. The transfer sheet after the image of one side was copy fixed is conveyed from the paper delivery roller 31 to an inlet roller 35 of the lower conveying unit and passes through the setback roller 26 and an outlet roller 35 of the lower conveying unit and is conveyed to the position of the registration roller 22. After that, in a manner similar to the ordinary copy, the transferring and fixing operations of the second time are executed and the multiplex copied transfer sheet is delivered to the outside of the apparatus.

In case of the both-sides copying mode, the transfer sheet after the image of the first surface was copy fixed is conveyed from the paper delivery roller 31 to the paper delivery roller 33. The paper delivery roller 33 which has been driven by a stepping motor (not shown) is reversely rotated for a time interval from a time point at which the rear edge of the transfer sheet passed through the flapper 32 to a time point at which it goes through the paper delivery roller 33. The flapper 32 is lifted up toward the upper side. The transfer sheet which was switched back is conveyed to the inlet roller 35 of the lower conveying unit and passes through the setback roller 26 and the outlet roller 35 of the lower conveying unit and is conveyed to the position of the registration roller 22. After that, the copying operation of the second surface is executed in a manner similar to the ordinary copying mode. The transfer sheet on which the images were copied to both sides is delivered to the outside of the apparatus. Reference numeral 36 denotes a separation flapper and 23 indicates a pre-transfer charging device.

Figure 2:
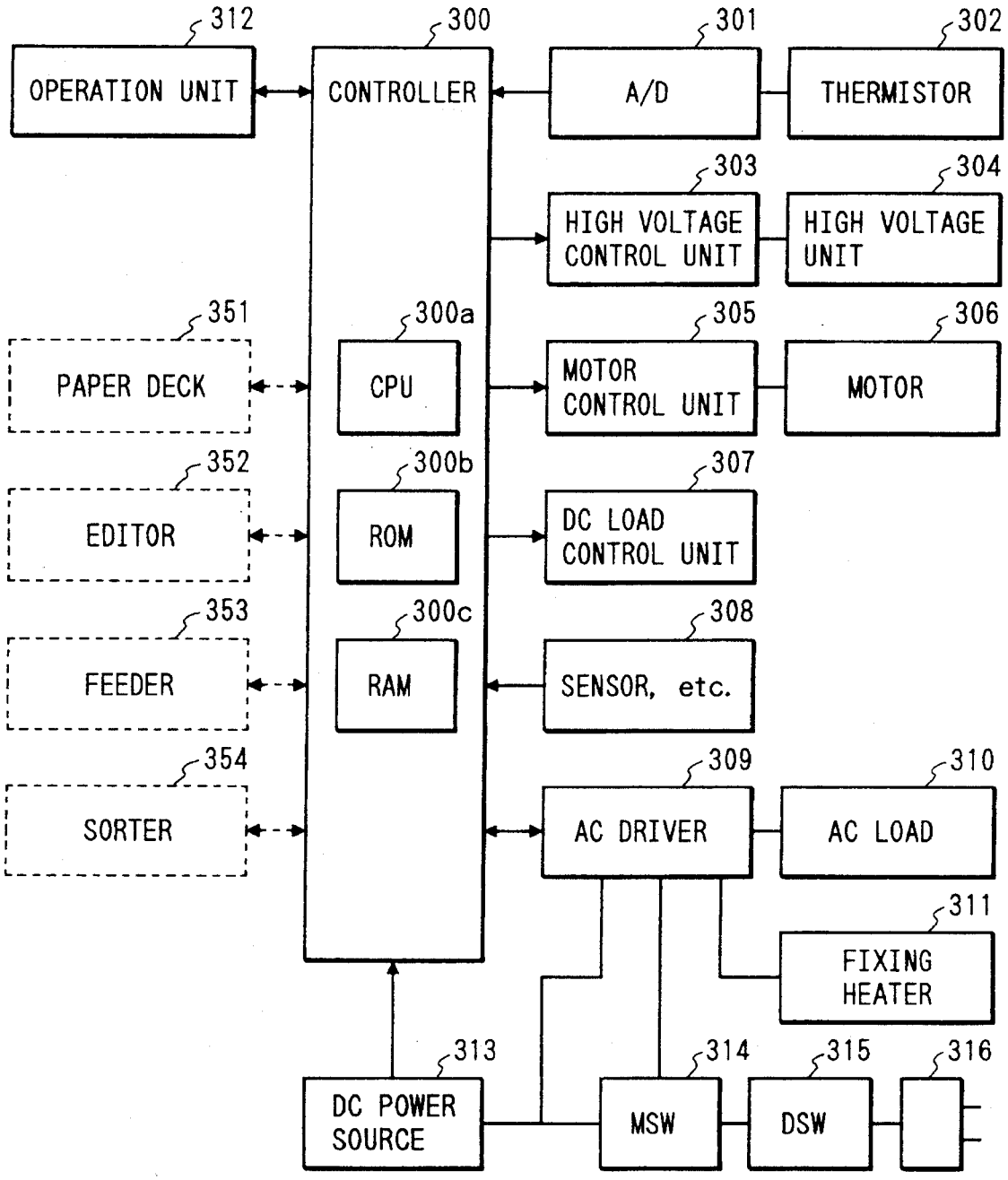
FIG. 2 is a block diagram for explaining a control construction of the copying apparatus shown in FIG. 1.

FIG. 2 is a control block diagram of the copying apparatus shown in FIG. 1.

Reference numeral 300 denotes a controller comprising: a CPU 300*a;* an ROM 300*b;* an RAM 300*c;* and the like. The controller 300 integratedly controls a copying sequence on the basis of programs stored in the ROM 300*b*.

Reference numeral 312 denotes an operation unit comprising a key input unit and a display unit. The key input unit has: a copying mode (one side/bothsides/multiplex mode, copy magnification, paper feed cassette selection, etc.) setting key; a ten-key to set the number of copy papers or the like; a start key to instruct the start of the copying operation; a stop key to instruct the stop of the copying operation; a reset key to reset the operating mode into a standard state; and the like. The display unit is constructed by an LED, a liquid crystal, or the like to display a set state of the operating mode or the like. Reference numeral 302 denotes the thermistor for detecting the surface temperature of the fixing roller 30. The controller 300 controls the surface temperature of the fixing roller 30 so as to be a predetermined value in accordance with the detected temperature.

A high voltage control unit 303 controls a high voltage unit 304 for applying predetermined voltages to the charging system such as primary charging device 9, transfer charging device 24, and the like, the first developing device 16, and the like. A motor control unit 305 controls the driving of a motor 306 such as various kinds of stepping motors, main driving motor, and the like. A DC load control unit 307 controls the driving of solenoids for the feed roller 21 and the like, clutches and fans for the vertical path roller 18 and the like, etc. Reference numeral 308 denotes a sensor and the like for detecting a paper jam of the transfer sheet and the like. Detection signals of the sensor and the like 308 are input to the controller 300.

An AC driver 309 controls an AC power supply to an AC load 310 such as original illuminating lamp 4 and the like and an AC power supply to the fixing heater 311. The AC driver 309 detects abnormality of the lamp 4, fixing heater 311, and the like and turns off a main switch (MSW) 314 with a shut-off function. A DC power source 313 supplies DC power sources to the controller 300 and the like. The AC power source applied from a power source plug 316 is supplied to the DC power source 313 through a door switch (DSW) 315 and main switch 314. A paper deck 351 denotes a paper feeding apparatus to increase the number of transfer sheets which can be stacked. The paper feeding apparatus 351 is connected as an option to the copying apparatus. An editor 352 is used to input position information for a trimming process, a masking process, and the like. The editor 352 is connected as an option to the copying apparatus.

A feeder 353 is used to automatically set a plurality of originals onto the original supporting plate S and is connected as an option to the copying apparatus. A sorter 354 is used to sort the transfer sheets which are delivered to the outside of the apparatus and is connected as an option to the copying apparatus.

In the copying apparatus constructed as mentioned above, when sheet detecting means (sheet detecting sensor 37 at the inlet of the lower conveying unit which will be explained hereinlater) detects the front edge of the transfer sheet which is conveyed by the sheet conveying roller (inlet roller 34 of the lower conveying unit), the loop forming means (CPU 300*a*) forms a loop by controlling a conveyance amount from the transfer sheet edge detecting position to a position at which the transfer sheet runs into the sheet conveying roller (setback roller 26). The setback control means (motor control unit 305) controls the forward rotation or reverse rotation of each sheet conveying roller, thereby allowing the transfer sheet which was run into the sheet conveying roller in a state in which the loop was formed to be stacked and enclosed onto a predetermined conveying path at a predetermined interval. Due to this, a stacking and enclosing interval of each transfer sheet can be made constant so as to enable each transfer sheet to be certainly separated and again fed even if the number of transfer sheets which are conveyed is increased or decreased.

On the other hand, the loop forming means forms a loop of a variable amount according to the loop data selected from the memory means (RAM 300*c*) on the basis of the set transfer sheet conveying conditions and sheet detection output state of the sheet detecting means, so that the loop of the optimum variable amount adapted to the transfer sheet conveying condition can be individually formed.

Further, since a run-into conveyance amount of each transfer sheet is variably changed for every number of transfer sheets which are stacked onto a predetermined conveying path, the loop forming means can form the optimum variable amount of loop for every number of transfer sheets.

On the other hand, since a run-into conveyance amount of each transfer sheet is decreased each time the number of transfer sheets which are stacked onto a predetermined conveying path increases, the loop forming means can set a stacking and enclosing interval of each transfer sheet to a constant value so that the sheet can certainly be separated and again fed.

Further, a run-into conveyance amount of each transfer sheet is variably changed on the basis of the image forming mode for the transfer sheets which are stacked onto a predetermined conveying path, even if a curl occurs on the transfer sheet in the vertical direction, the loop forming means can set a stacking and enclosing interval of each transfer sheet to a constant value so that the sheet can be certainly separated and again fed.

Even if a conveying fraction defective of every number of transfer sheets which are stacked increases, the correcting means automatically corrects a run-into conveyance amount of each transfer paper for every number of transfer sheets which are stacked on the basis of the count value counted by the first counter means (internal timer of the CPU 300*a*). Therefore, a stacking and enclosing interval of each transfer sheet can be set to a constant value so that the transfer sheet can be certainly separated and again fed even if an aging change of the friction of the sheet conveying roller occurs.

Moreover, desired adjustment data is input and a run-into conveyance amount is adjusted while monitoring the count value counted by the first counter and the run-into conveyance amount of every number of stacked transfer sheets which are displayed by the first display means (display unit in the operation unit 312). Therefore, a variable amount of loop according to an aging change of the friction of the sheet conveying roller can be formed.

The first setback operation on the lower conveying path in the copying apparatus of the embodiment will now be described hereinbelow with reference to FIGS. 3 to 13.

Figure 3:
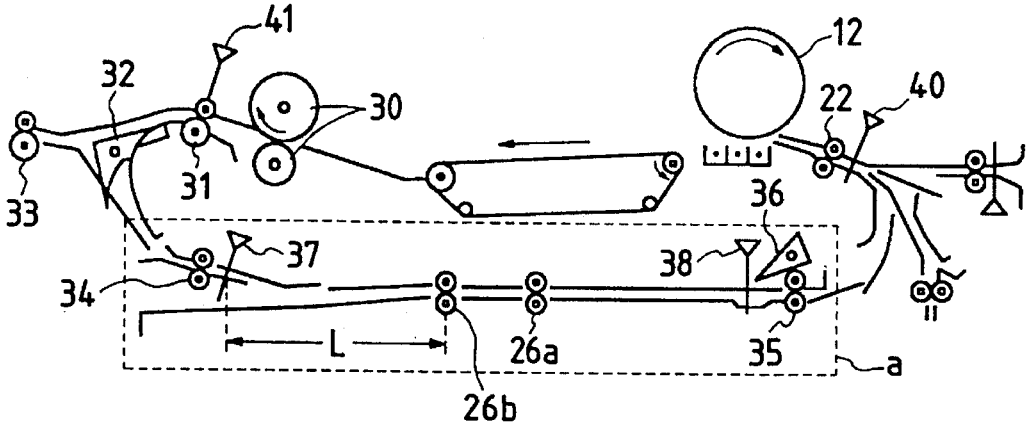
FIG. 3 is a detailed cross sectional view of a lower conveying path system of the copying apparatus shown in FIG. 1.

FIG. 3 is a detailed cross sectional view showing a part of the paper feed conveying system A of the copying apparatus shown in FIG. 1. FIGS. 4 to 13 are diagrams each showing a first setback state transition in the copying apparatus according to the present invention. Construction and operation will now be described hereinbelow.

The inlet roller 34 of the lower conveying unit and outlet roller 35 of the lower conveying unit shown in FIG. 3 are driven by the main motor. The setback roller 26 (comprising setback rollers 26*a* and 26*b*) is driven by an exclusive-use stepping motor. The separation flapper 36 is driven by a solenoid (not shown).

Figure 4:
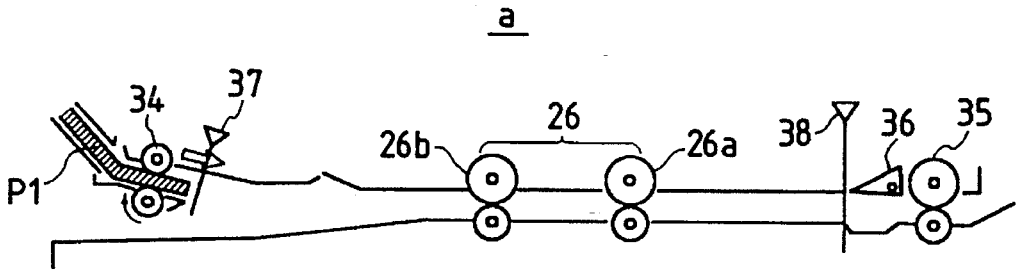
FIG. 4 is a diagram showing a sheet re-feeding state transition from a lower conveying unit in the copying apparatus.
Figure 5:
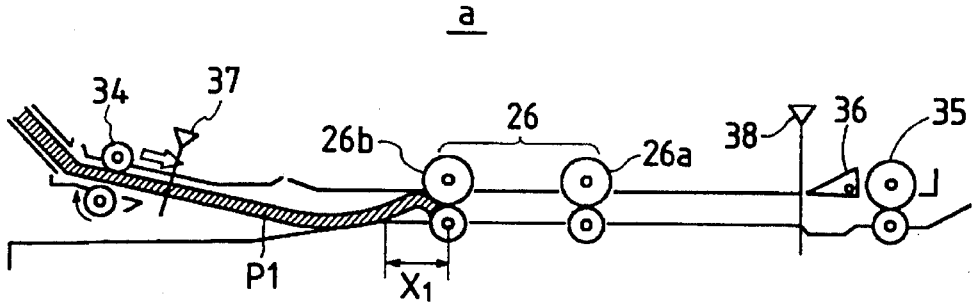
FIG. 5 is a diagram showing a sheet re-feeding state transition from the lower conveying unit in the copying apparatus.
Figure 6:
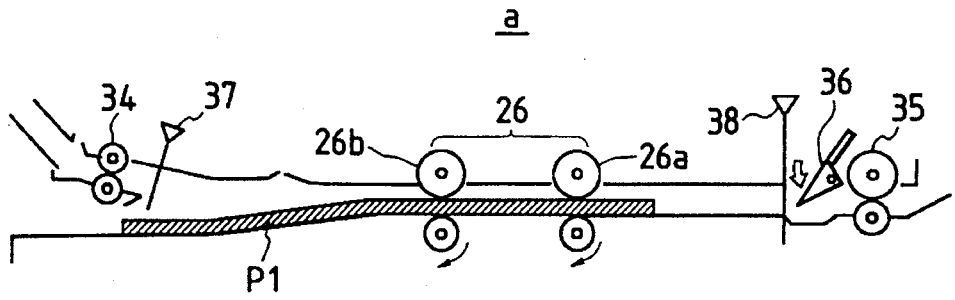
FIG. 6 is a diagram showing a sheet re-feeding state transition from the lower conveying unit in the copying apparatus.
Figure 7:
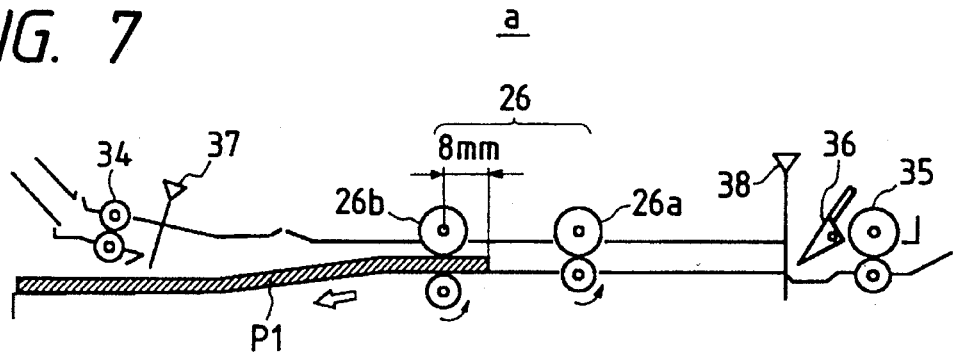
FIG. 7 is a diagram showing a sheet re-feeding state transition from the lower conveying unit in the copying apparatus.
Figure 8:
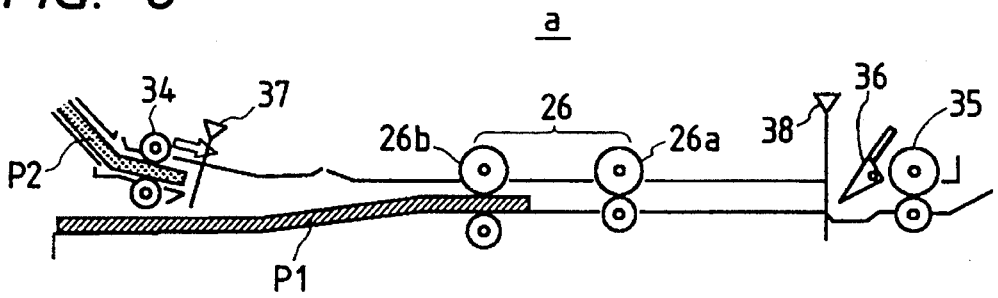
FIG. 8 is a diagram showing a sheet re-feeding state transition from the lower conveying unit in the copying apparatus.
Figure 9:
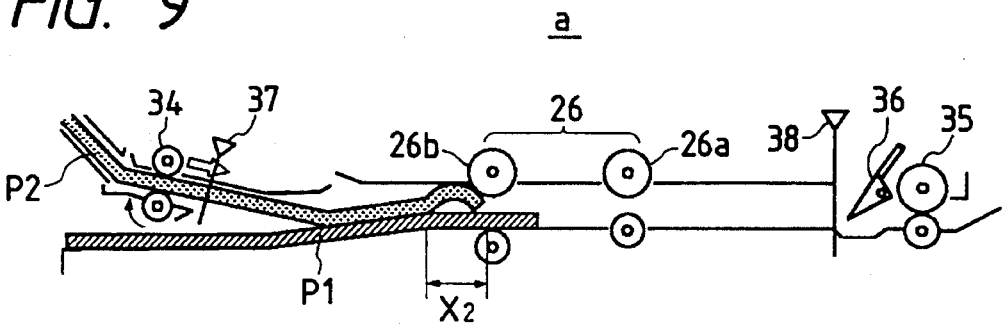
FIG. 9 is a diagram showing a sheet re-feeding state transition from the lower conveying unit in the copying apparatus.
Figure 10:
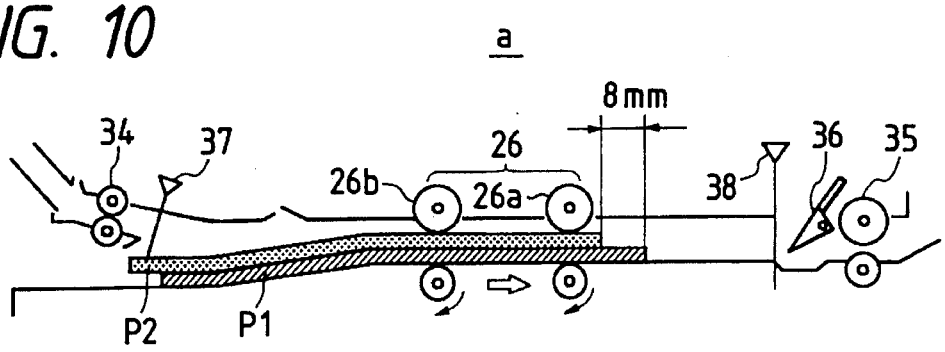
FIG. 10 is a diagram showing a sheet re-feeding state transition from the lower conveying unit in the copying apparatus.
Figure 11:
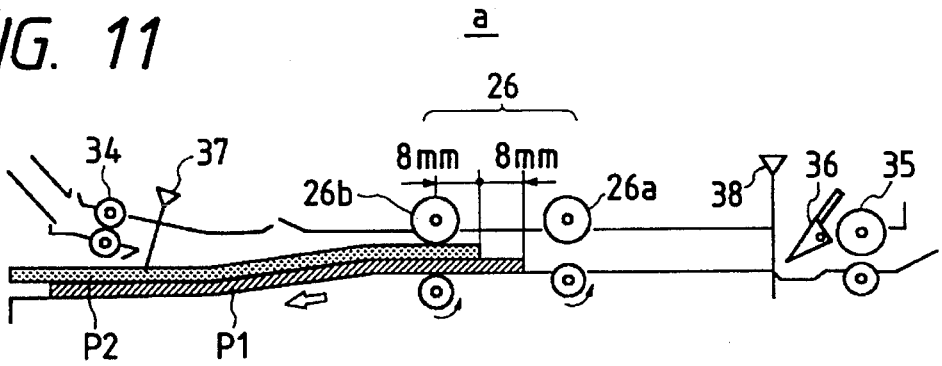
FIG. 11 is a diagram showing a sheet re-feeding state transition from the lower conveying unit in the copying apparatus.

Specifically, when the first transfer sheet $P_1$ is conveyed from a lower conveying unit a by the inlet roller 34 of the lower conveying unit as shown in FIG. 4, the front edge of the transfer sheet $P_1$ is detected by the inlet sheet detecting sensor 37 of the lower conveying unit as shown in FIG. 5. The setback roller 26*b* is stopped until it is driven by the inlet roller 34 of the lower conveying unit by a predetermined amount from the sensor 37, thereby allowing the front edge of the sheet to run into the setback roller 26*b* and forming a loop so that a loop amount of the transfer sheet is equal to $x_1$. The oblique movement of the transfer sheet is corrected by the formation of the loop and the position of the front edge of the transfer sheet can be correctly recognized. After that, as shown in FIG. 6, the separation flapper 36 is lifted down. The driving of the inlet roller 34 is continued and the setback rollers 26*a* and 26*b* are forwardly rotated, thereby feeding the transfer sheet $P_1$ in the outlet direction of the lower conveying unit. The rear edge of the transfer sheet $P_1$ is pulled out from the inlet portion of the lower conveying unit and is picked up. Subsequently, as shown in FIG. 7, each of the setback rollers 26*a* and 26*b* is reversely rotated by a predetermined amount. The driving of the setback roller 26 is stopped at a position where the front edge of the transfer sheet $P_1$ is projected to the outlet side from the center of the setback roller 26*b* by 8 mm. Then, the second transfer sheet $P_2$ is conveyed to the lower conveying unit as shown in FIG. 8. As shown in FIG. 9, the front edge of the second transfer sheet $P_2$ is detected by the inlet sheet detecting sensor 37 of the lower conveying unit as shown in FIG. 9. The inlet roller 34 of the lower conveying unit is driven by a predetermined amount that is smaller than .that in case of the transfer sheet $P_1$ from the sensor 37. A loop is formed in a manner such that the front edge of the transfer sheet $P_2$ runs into the second setback roller 26b and a loop amount is equal to $x_2$ (loop amount $x_1$ of the first transfer sheet > loop amount $x_2$ of the second transfer sheet). As shown in FIG. 10, the setback rollers 26a and 26b are subsequently forwardly rotated and the rear edge of the second transfer sheet $P_2$ is pulled and picked up from the inlet of the lower conveying unit to the outside. As shown in FIG. 11, each of the setback rollers 26a and 26b is reversely rotated by a predetermined amount. The driving of the setback roller 26 is stopped at a position where the front edge of the second transfer sheet $P_2$ is projected to the outlet side from the center of the setback roller 26b by 8 mm than the second setback roller 26b.

The above processes shown in FIGS. 4 to 11 are repeated a number of times as many as a predetermined number of transfer sheets and the predetermined number of transfer sheets are stacked and enclosed into the lower conveying unit in a state in which they are respectively deviated little by little. An amount of loop which is formed by the setback roller 26b is changed in accordance with the number of stacked transfer sheets in a manner such that the loop amount is set to $x_1$ for the first sheet, $x_2$ for the second sheet, $x_3$ for the third sheet, $x_4$ for the fourth sheet, . . . , $x_y$ for the yth sheet ($x_1>x_2>x_3>x_4> \ldots >x_y$). In the embodiment, the loop amount in the setback roller 26b has been changed every transfer sheet. However, the invention is not limited to such an example. It is also possible to set each loop amount in a manner such that in order to certainly correct the oblique movement of the first transfer sheet, the loop amount of the first sheet is set to a large value $X_1$ ($X_1 \gg x_1$) and that the loop amounts of the second and subsequent transfer sheets are set to a value $x_2$ ($x_1>x_2$) which is not so large that a stacking state of the transfer sheets is not broken. Further, it is also possible to change the loop amount on a unit basis of a predetermined number of transfer sheets in a manner such that the loop amount of the first sheet is set to $x_1$ and the loop amounts of the second to tenth sheets are set to $x_{10}$ and the loop amounts of the eleventh to twentieth sheets are set to $x_{20}$.

Figure 12:
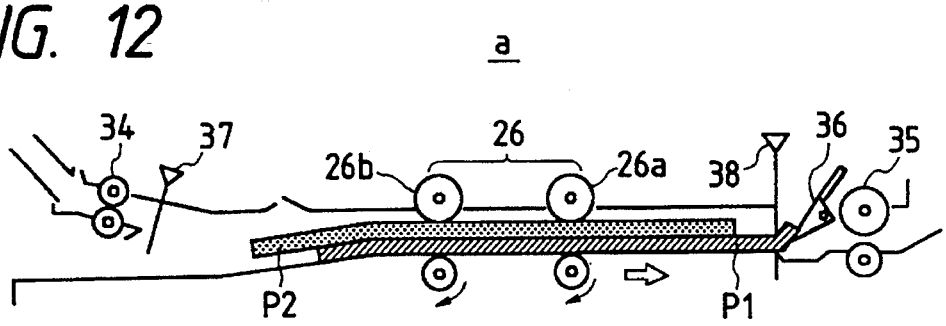
FIG. 12 is a diagram showing a sheet re-feeding state transition from the lower conveying unit in the copying apparatus.
Figure 13:
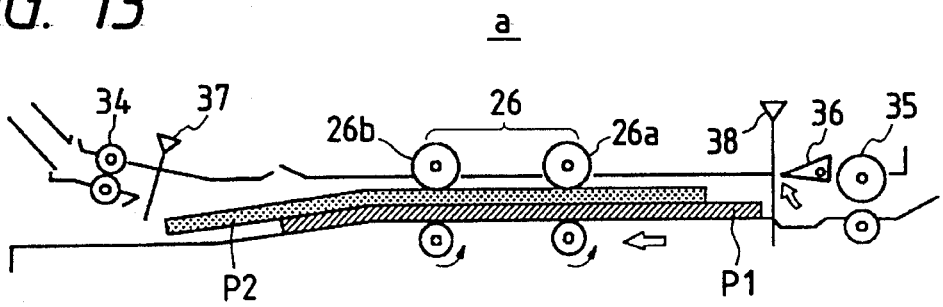
FIG. 13 is a diagram showing a sheet re-feeding state transition from the lower conveying unit in the copying apparatus.

After the stacking process of the transfer sheets in the lower conveying unit was finished as mentioned above, the setback rollers 26a and 26b are forwardly rotated as shown in FIG. 12 for preparation of re-feeding of the sheets from the lower conveying unit. When the front edge of the first transfer sheet $P_1$ is detected by the outlet sheet detecting sensor 38 of the lower conveying unit, the setback rollers 26a and 26b are stopped. As shown in FIG. 13, subsequently, the setback rollers 26a and 26b are reversely rotated, the front edge of the first transfer sheet $P_1$ is stopped in front of a outlet sheet detecting sensor 38 of the lower conveying unit, and the separation flapper 36 is lifted up.

The paper re-feeding operation from the lower conveying unit in the copying apparatus of the embodiment will now be described hereinbelow with reference to FIGS. 14 to 18.

FIGS. 14 to 18 are diagrams each showing a paper re-feeding state transition from the lower conveying unit in the copying apparatus.

Figure 14:
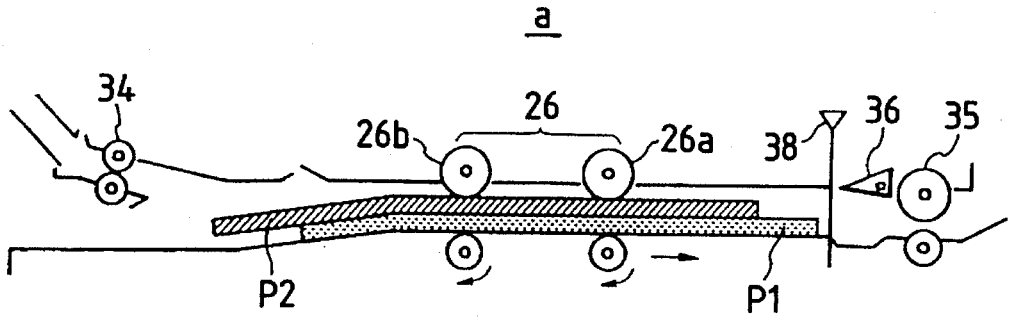
FIG. 14 is a diagram showing a sheet re-feeding state transition from the lower conveying unit in the copying apparatus.
Figure 15:
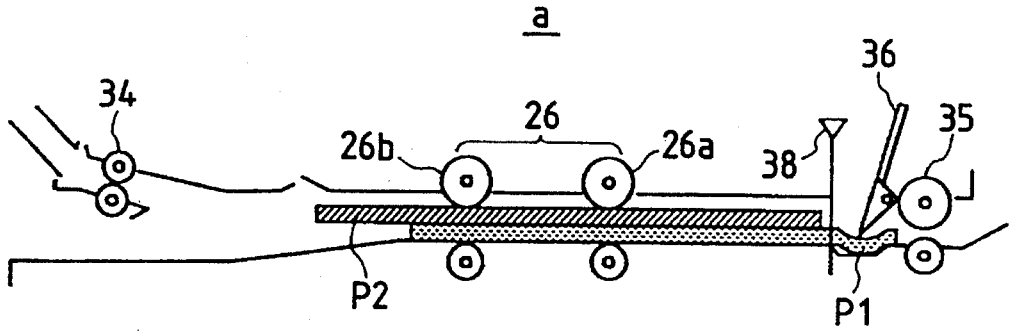
FIG. 15 is a diagram showing a sheet re-feeding state transition from the lower conveying unit in the copying apparatus.
Figure 16:
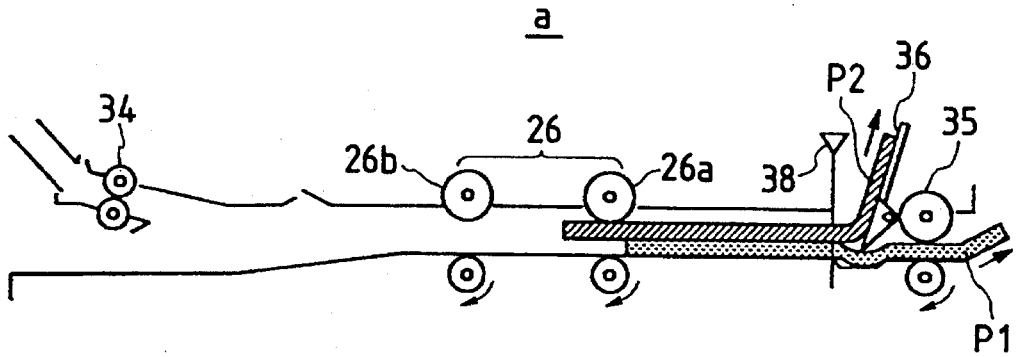
FIG. 16 is a diagram showing a sheet re-feeding state transition from the lower conveying unit in the copying apparatus.
Figure 17:
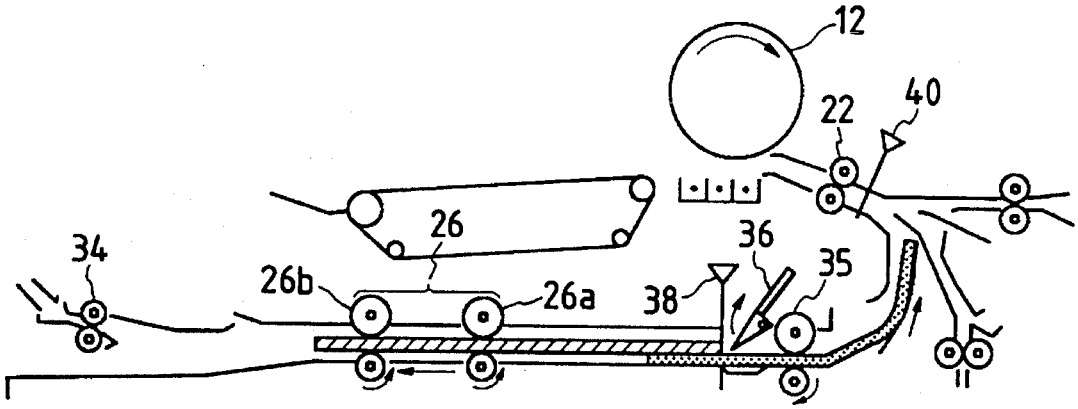
FIG. 17 is a diagram showing a sheet re-feeding state transition from the lower conveying unit in the copying apparatus.
Figure 18:
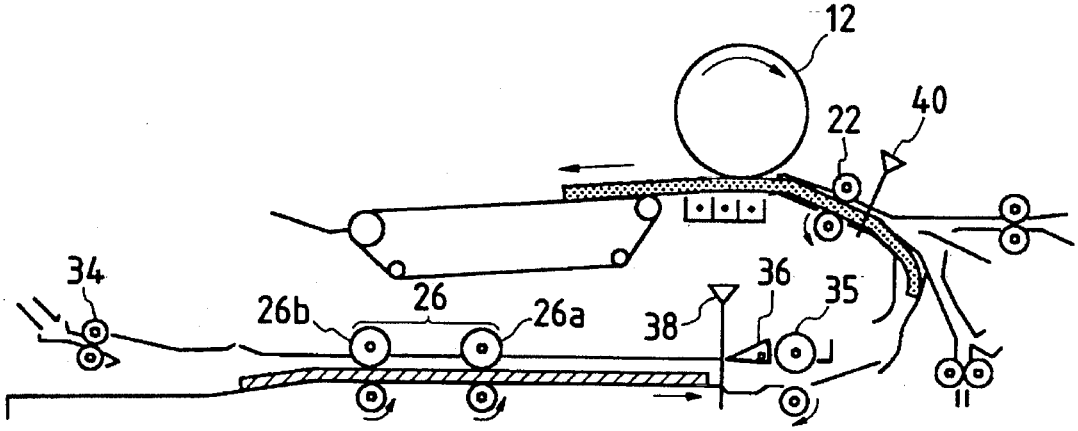
FIG. 18 is a diagram showing a sheet re-feeding state transition from the lower conveying unit in the copying apparatus.

First, the setback rollers 26a and 26b are forwardly rotated by a second side copy starting command as shown in FIG. 14. Subsequently, as shown in FIG. 15, after the elapse of a predetermined time after the front edge of the first transfer sheet $P_1$ had been detected by the outlet sheet detecting sensor 38 of the lower conveying unit, the setback rollers 26a and 26b are stopped and the separation flapper 36 is lifted down. Subsequently, as shown in FIG. 16, the setback rollers 26a and 26b are again forwardly rotated and the first and second transfer sheets $P_1$ and $P_2$ are separated by the separation flapper 36. The outlet roller 35 of the lower conveying unit is driven by turning on an outlet clutch (not shown) of the lower conveying unit at a timing when the front edge of the first transfer sheet $P_1$ runs into the outlet roller 35 of the lower conveying unit. When the rear edge of the first transfer sheet $P_1$ goes through the setback roller 26 as shown in FIG. 17, the setback roller 26 is reversely rotated, the second transfer sheet $P_2$ is returned, and the separation flapper 36 is lifted up. The setback roller 26 is stopped at a time point when the front edge of the second transfer sheet $P_2$ is detected by the outlet sheet detecting sensor 38 of the lower conveying unit. As shown in FIG. 18, after the front edge of the first transfer sheet $P_1$ was detected by a pre-registration sheet detecting sensor 40, a predetermined amount of loop is formed by the registration roller 22. The roller 22 is driven by turning on a registration clutch (not shown), thereby performing the second copy transfer. After the elapse of a predetermined time after the roller 22 had been driven, the setback roller 26 is forwardly rotated and the second transfer sheet $P_2$ is fed in a manner similar to the first transfer sheet $P_1$.

The setback control and sheet re-feeding control will be described hereinbelow with reference to FIGS. 19 and 20.

Figure 19:
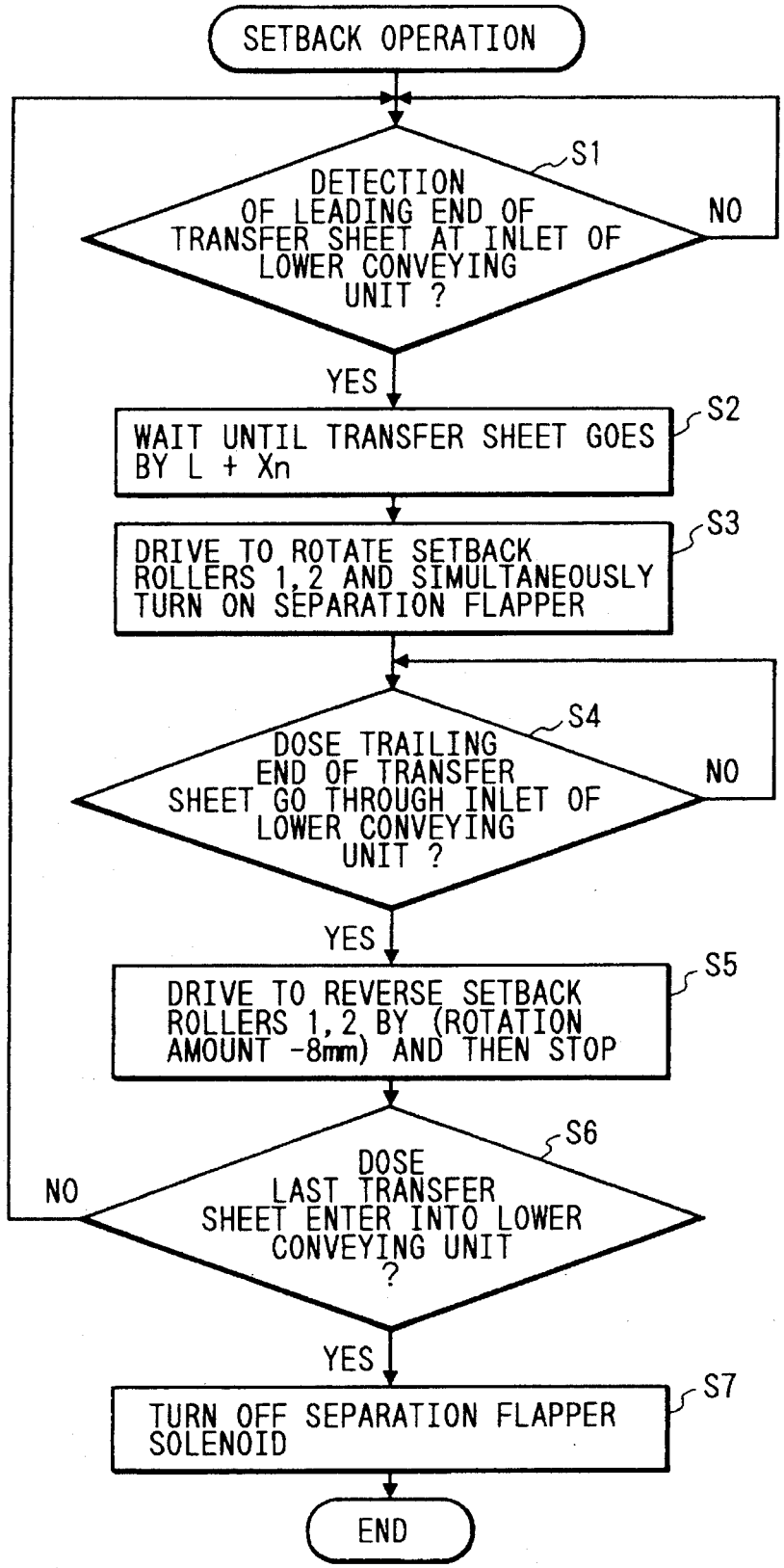
FIG. 19 is a flowchart showing an example of a setback control procedure in the copying apparatus.

FIG. 19 is a flowchart showing an example of a setback control procedure. Steps S1 to S7 show control programs which have been stored in the ROM 300b and are executed by the CPU 300a shown in FIG. 2.

First, as shown in FIG. 4, a check is made to see if the front edge of the transfer sheet has been detected by the inlet roller 34 of the lower conveying unit at the inlet of the lower conveying unit or not (S1). If YES, the apparatus waits until the transfer sheet goes by the distance of (a distance L from the detecting position to the setback roller 26b)+(a loop amount $x_n$ of the n-th transfer sheet in the setback roller 26b) (step S2). A loop as shown in FIG. 5 is formed.

Subsequently, the setback rollers 26a and 26b are forwardly rotated and the separation flapper solenoid is turned on, thereby lifting down the separation flapper 36 (S3). The apparatus waits until the rear edge of the transfer sheet goes through the inlet portion of the lower conveying unit as shown in FIG. 6 (S4). When it goes through the inlet portion, as shown in FIG. 7, the setback rollers 26a and 26b are reversely driven so as to return the transfer sheet by a distance of (forward rotation amount—8 mm) and are stopped after that (S5). The processes in steps (S1 to S5) are repeated until the number of transfer sheets which are conveyed to the lower conveying unit is equal to the designated number, namely, until the transfer sheet which enters the lower conveying until is the last sheet (S6). When the transfer sheet which enters the lower conveying unit is the last sheet, the separation flapper solenoid is turned off and the separation flapper 36 is lifted up (S7) and the processing routine is finished.

Figure 20:
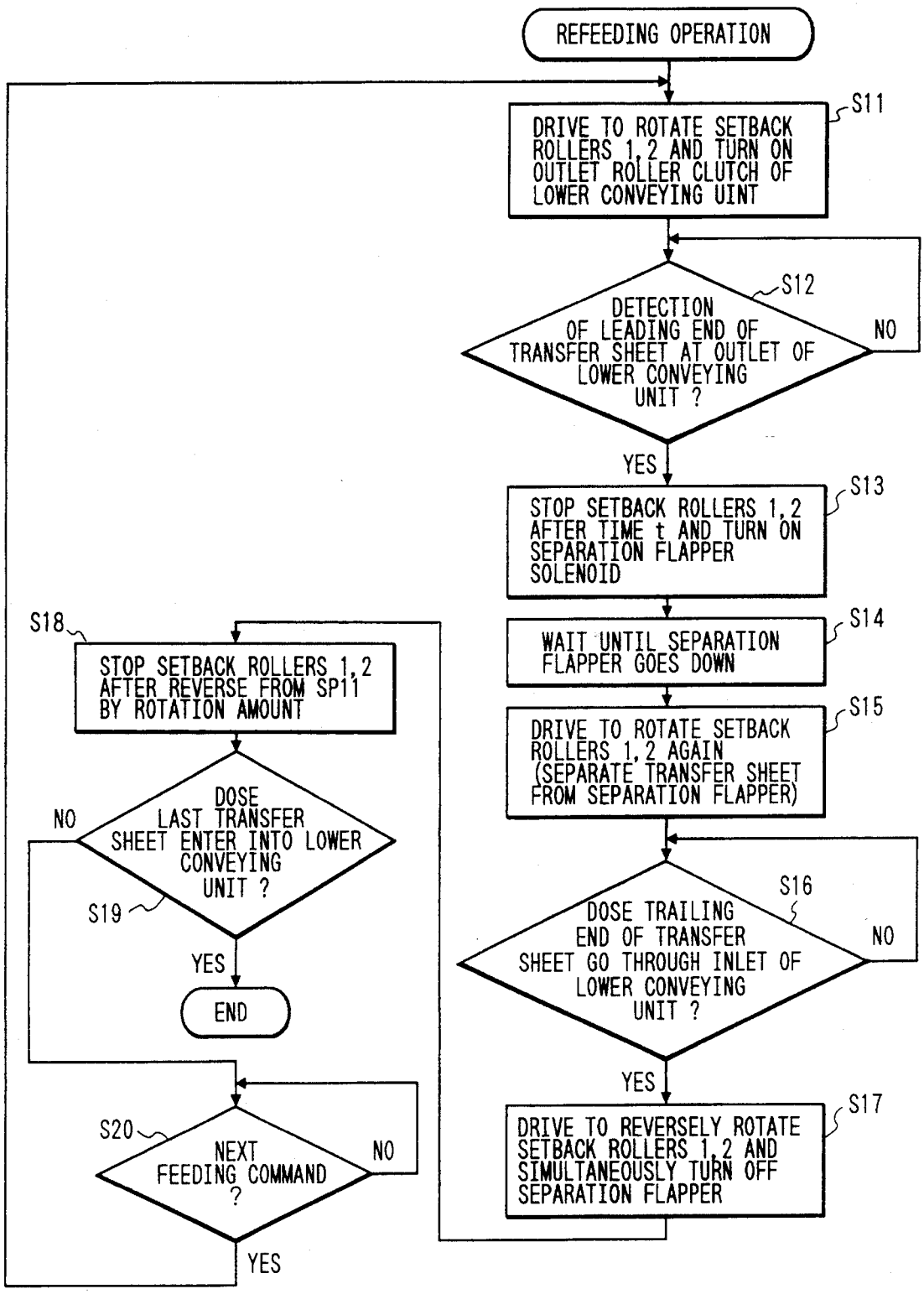
FIG. 20 is a flowchart showing an example of a sheet re-feeding control procedure in the copying apparatus.

FIG. 20 is a flowchart showing an example of a sheet re-feeding control procedure. Steps S11 to S20 show control programs which have been stored in the ROM 300b and are executed by the CPU 300a shown in FIG. 2.

First, as shown in FIG. 14, the setback rollers 26a and 26b are forwardly driven and the outlet roller clutch of the lower conveying unit is turned on (S11), thereby driving the outlet roller 35 of the lower conveying unit. As shown in FIG. 15, when the outlet sheet detecting sensor 38 of the lower conveying unit detects the front edge of the transfer sheet $P_1$ (S12), the setback rollers 26a and 26b are stopped. After the elapse of time t, the setback rollers 26a and 26b are stopped and the separation flapper solenoid is turned on (S13). The apparatus waits until the separation flapper 36 is lifted down as shown in FIG. 15 (S14). The setback rollers 26*a* and 26*b* are again forwardly driven and the adjacent transfer sheets $P_1$ and $P_2$ on the upper and lower sides are separated by the separation flapper 36 as shown in FIG. 16 (S15). The apparatus waits until the rear edge of the transfer seet $P_1$ on the lower side goes through the setback roller 26*a* (S16). When it goes, the setback rollers 26*a* and 26*b* are reversely driven and the separation flapper solenoid is turned off, thereby lifting up the separation flapper 36 (S17). Subsequently, the setback rollers 26*a* and 26*b* are stopped (S18) at a timing when the transfer sheet was returned by the distance at which the transfer sheet $P_2$ on the upper side was fed to the front side as shown in FIG. 17. A check is made to see if the transfer sheet remaining in the lower conveying unit is the last sheet or not (S19). If YES, the processing routine is finished. If NO, the apparatus waits for the input of the next paper feeding command (S20). When the next paper feeding command is input, the processing routine is returned to step S11 and the processes in steps S11 to S19 are repeated.

The embodiment has been described above with respect to the case where the result regarding whether the image has been transferred to which one of both sides of the transfer sheet that is conveyed to the lower conveying unit is not considered but a loop amount for the subsequent transfer sheet is changed. However, as a state of the transfer sheet which is stacked into the lower conveying unit, there are a case where the transfer sheet is stacked in a state in which the transfer surface of the first side is upside down (in the multiplex copying mode) and a case where the sheet is stacked in a state in which the transfer surface of the first side is upside up (both-sides copying mode) in dependence on the copying mode (multiplex copying mode/both-sides copying mode).

After the image was transferred to the first side of the transfer sheet, it is fixed, so that a curl easily occurs. The curled transfer sheet is conveyed to the lower conveying unit. Therefore, the transfer sheet is run into the setback roller 26*b* in a lower curled state and a loop is formed or the transfer sheet is run into the setback roller 26*b* in an upper curled state and a loop is formed in dependence on the copying mode (multiplex copying mode/both-sides copying mode). In this case, even if the loop amounts of the upper and lower curls are equal, forming states of the loops are obviously different or run-into states in which the transfer sheet is run into a gap between the transfer sheets stacked to the setback rollers 26*a* and 26*b* are obviously different. Therefore, in case of performing the control such that the loop amounts are always set to the same value, there is a fear such that it is difficult to stack the transfer sheets by setting the deviation amounts of the conveying direction of the transfer sheets when stacking them to be a predetermined value.

Therefore, it is also possible to construct so as to change the amount of loop which is formed by the setback roller 26*b* on the basis of the state in which the transfer sheets are stacked into the lower conveying unit (whether the first transferred image surface is downward/upward) as will be described hereinlater. The setback control operation of another embodiment will now be described with reference to FIGS. 21 and 22 hereinbelow.

Figure 21:
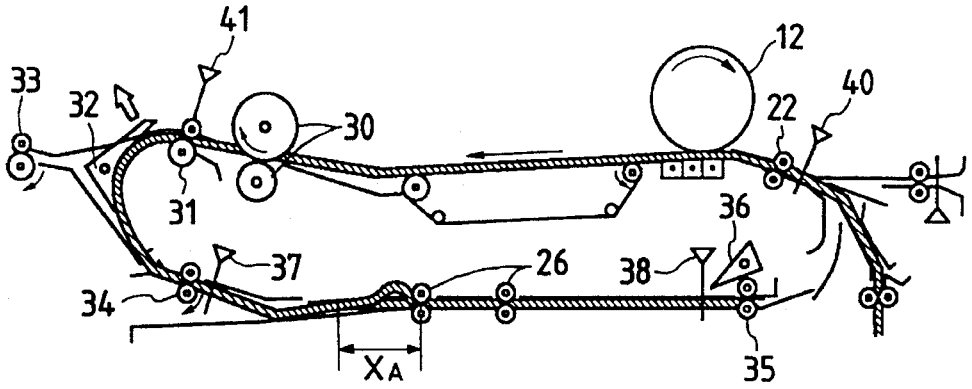
FIG. 21 is a diagram for explaining another setback control state in the copying apparatus.
Figure 22:
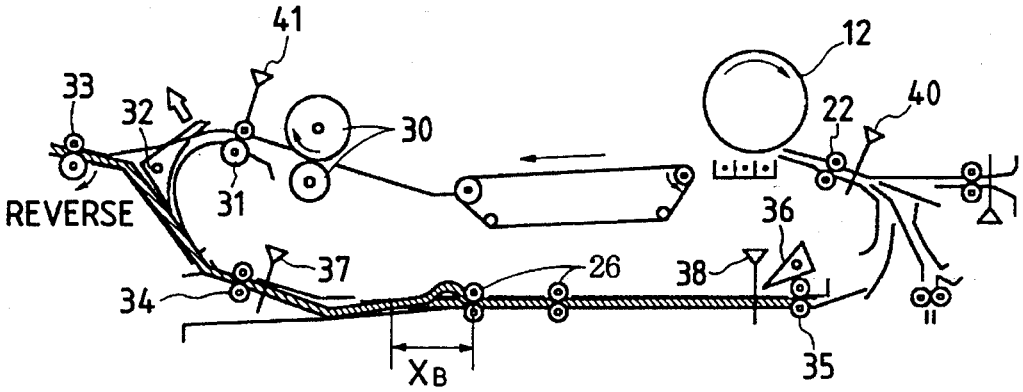
FIG. 22 is a diagram for explaining another setback control state in the copying apparatus.

FIGS. 21 and 22 are diagrams for explaining a setback control state of another embodiment. Component elements as those shown in FIGS. 1 and 3 are designated by the same reference numerals.

In case of the multiplex copying mode, after completion of the copy transfer of the image of the first side as shown in FIG. 21, the second paper delivery roller 33 is reversely rotated, the flapper 32 is lifted up, and the transfer sheet is conveyed to the lower conveying unit. After the inlet sheet detecting sensor 37 of the lower conveying unit detected the front edge of the transfer sheet, the sheet is conveyed by a predetermined amount, the sheet is run into the setback roller 26*b*, and the loop amount is controlled so as to be $x_A$.

On the other hand, in case of the bothsides copying mode, as shown in FIG. 22, after completion of the copy transfer of the image of the first side, the rear edge of the transfer sheet on which the image was fixed passes through a paper delivery detecting sensor 41. After the elapse of a predetermined time from the detection of the sheet rear edge, the second paper delivery roller 33 is reversely rotated and the flapper 32 is switched to the upper side. Due to this, the transfer sheet is switched back and conveyed to the lower conveying unit. After the front edge of the transfer sheet was detected by the inlet sheet detecting sensor 37 of the lower conveying unit, the transfer sheet is conveyed by a predetermined amount and is run into the setback roller 26*b* and the loop amount is controlled so as to be $x_B$ ($<x_A$).

The magnitude relation between the loop amounts $x_A$ and $x_B$ can be reversed in dependence on a factor such as an approach angle from the conveying path to the setback roller 26. Further, as shown in the embodiment, it is also possible to construct so as to perform a control for changing a loop amount in consideration of the relation of the loop amounts every number of transfer sheets.

In the copying apparatus main body, when the number of use years, the number of image forming sheets, and the like increase, the sheet conveying efficiency due to the setback operation deteriorates due to a friction or the like of the roller. There is also a case where the sheet conveying efficiency due to the setback operation deteriorates by differences of stiffness and charging property of the transfer sheet in dependence on the use environment. To solve those problems, the number of defective conveyance times or conveying fraction defective (ratio) of every number of stacked transfer sheets is counted by the controller 300. Those count values are stored as a backup into the RAM 300*c*. In the case where those count values occur a number of times corresponding to the values stored in the ROM 300*b*, for example, ten or more times, the loop amount of the number of stacked transfer sheets is increased to or decreased from the present value (for example, the present loop amount −2 mm), the stacking state in the lower conveying unit can be always held in a good state. The value of the present loop amount of every number of transfer sheets is rewritten by correcting the above increased or decreased value by the controller 300 and is stored into the RAM 300, thereby performing a feedback control to the next setback operation. A similar control can be also executed every image forming mode of a different stacking state in addition to the above method of controlling every number of stacked sheets.

A defective conveyance can be detected by using a well-known jam detecting means or overlap conveyance detecting means.

As shown in FIG. 23, the conveying fraction defective when the apparatus operates at every number of stacked transfer sheets is displayed on the screen of the operation unit 312 shown in FIG. 2. The value of the present (initial) loop amount and the adjustment value for such a number of stacked transfer sheets are displayed. On the basis of the display contents on the screen, for example, a service person judges from the conveying fraction defective and inputs the adjustment value and adjusts the set loop amount by increasing or decreasing it, thereby preferably executing the setback operation of the transfer sheet which is conveyed to the lower conveying unit. The stacked and enclosed transfer sheets can be preferably again fed. As a correcting and adjusting method in this instance, a ten-key, cursor key, or the like of the operation unit 312 is used, an item (for example, the sheet number) to be adjusted is selected and designated by a cursor K, and an adjustment value is input, thereby performing the adjustment, or an adjustment value is input from an external host computer through communicating means, thereby performing an adjustment from a remote place.

Further, as shown in FIG. 24, it is also possible to construct in a manner such that the conveying fraction defective of each mode of a different mode of the stacking state of the transfer sheets is displayed on the screen of the operation unit 312 and the value of the present (initial value) loop amount and the adjustment value for such a mode are displayed or that the setback operation is preferably executed every mode of the different stacking state of the transfer sheets which are conveyed to the lower conveying unit by adjusting in a manner similar to that mentioned above, thereby enabling the stacked and enclosed transfer sheets to be again fed preferably.

[Second embodiment]

Figure 25:
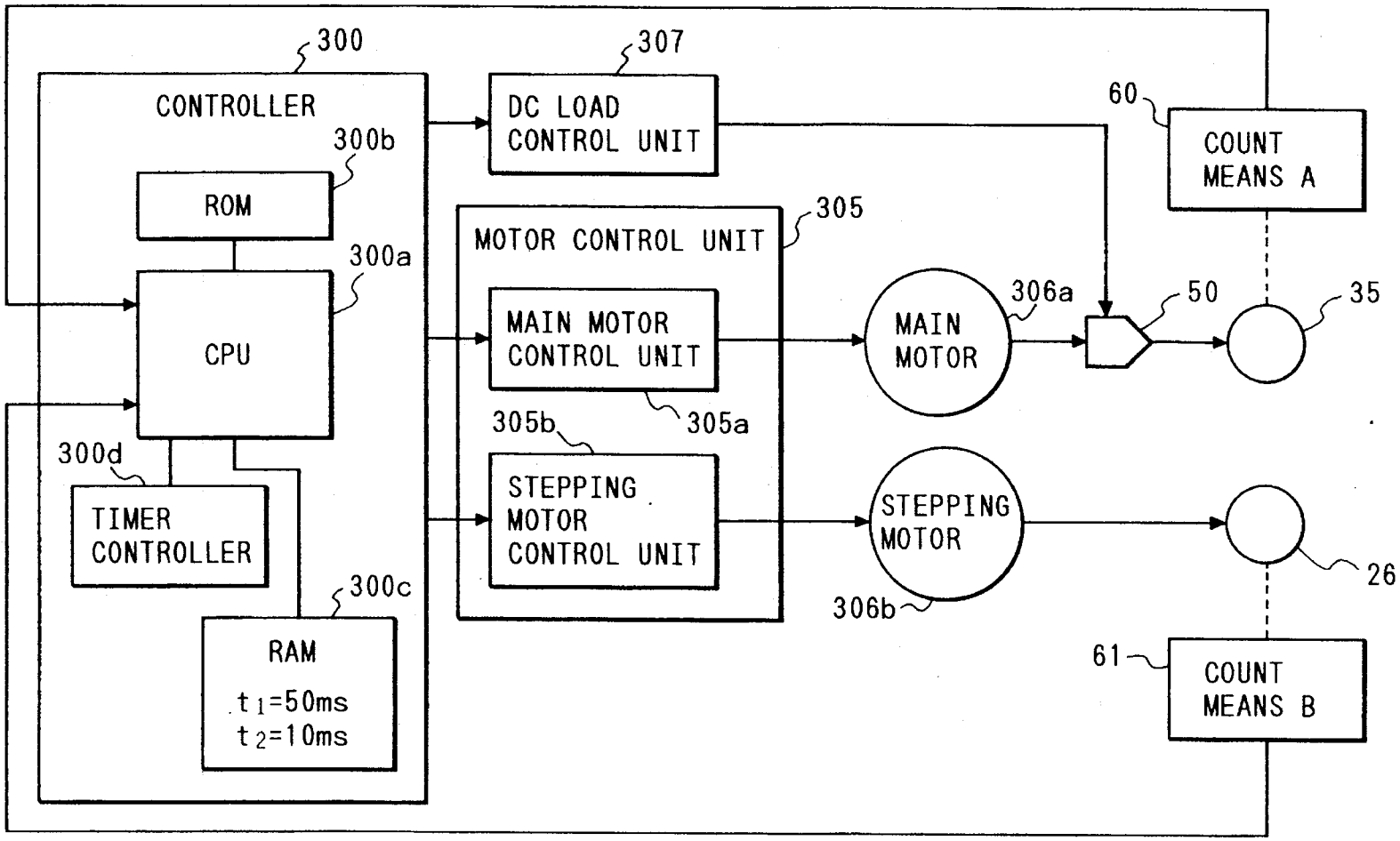
FIG. 25 is a block diagram for explaining a motor control construction of a copying apparatus showing an embodiment of the present invention.

FIG. 25 is a block diagram for explaining a control construction of a copying apparatus showing the second embodiment of the invention. The same component elements as those shown in FIG. 2 are designated by the same reference numerals. Construction and operation of the apparatus of the second embodiment will now be described hereinbelow.

The values of a rise time difference $t_1$= 50 msec of the driving and a driving stop (fall) time difference $t_2$=10 msec of the outlet roller 35 of the lower conveying unit and the setback roller 26 are held in the RAM 300*c*. Those values are obtained from the experimental data. Now assuming that the values of the time differences $t_1$ and $t_2$ are fixed values, they can be stored and held in the ROM 300*b* or into another memory holding means.

The CPU 300*a* of the controller 300 controls a main motor control unit 305*a* of the motor control unit 305 in accordance with control programs stored in the ROM 300*b*, thereby driving and stopping a main motor 306*a*. The DC load control unit 307 is controlled by the CPU 300*a* of the controller 300, thereby executing the coupling, disconnection, etc. of an outlet clutch 50 of the lower conveying unit. The outlet roller 35 is rotated and stopped. A stepping motor control unit 305*b* is controlled by the CPU 300*a* of the controller 300 and a stepping motor 306*b* is driven and stopped, thereby rotating and stopping the setback rollers 26*a* and 26*b* (which function as adjacent transfer sheet conveying means in the embodiment).

In case of conveying the transfer sheet sandwiched by both of the outlet roller 35 and the setback roller 26*b*, the outlet clutch 50 is coupled by the control of the CPU 300*a* and the value of the time difference $t_1$ in the RAM 300*c* is read out. After the elapse of time of 50 msec by the counting of a timer controller 300*d*, the stepping motor 306*b* is driven by the CPU 300*a*. Therefore, the outlet roller 35 and the setback rollers 26*a* and 26*b* simultaneously rise and rotate, thereby conveying the transfer sheet.

In the case where the transfer sheet during the conveyance is stopped in a state in which it is sandwiched by the outlet roller 35 and the setback roller 26, the coupling state of the outlet clutch 50 is cancelled by the control of the CPU 300*a* and the value of the time difference $t_2$ in the RAM 300*c* is read out. After the elapse of time of 10 msec counted by the timer controller 300*d*, the driving of the stepping motor 306*b* is stopped by the CPU 300*a* in accordance with the control program in the ROM 300*b*. Therefore, the outlet roller 35 and the setback roller 26*b* are simultaneously stopped and the transfer sheet is also stopped.

In the copying apparatus with the above construction, in the case where the timing control means (motor control unit 305) stops or starts the conveyance of the transfer sheet in a state in which the sheet is sandwiched by both of the adjacent sheet conveying rollers (setback rollers 26*a* and 26*b* in the embodiment) of different driving sources, the timing control means delays the stop or start timing of each of the sheet conveying rollers. Therefore, even when the transfer sheet is stopped in a state in which it is sandwiched by the adjacent sheet conveying rollers, the conveyance of the transfer sheet sandwiched by the sheet conveying rollers can be smoothly started or stopped.

Further, since the timing control means delays the stop or start timing of each of the adjacent sheet conveying rollers on the basis of the time counting state of a software timer of the CPU 300*a*, the delay amount can be freely changed.

On the other hand, since the timing control means delays the stop of start timing of each of the adjacent sheet conveying rollers on the basis of an output of a delay circuit 400, which will be explained hereinlater, the sheet conveying rollers can be always delayed at accurate timings.

Further, in the case where the conveyance of the transfer sheet is stopped or started in a state in which it is sandwiched by both of the adjacent sheet conveying rollers of different driving sources, the timing control means delays the stop or start timing of each of the adjacent sheet conveying rollers on the basis of the rise time difference or fall time difference of the adjacent sheet conveying rollers which was counted by time counting means (count means 60 and 61). Therefore, the present rise time or fall time difference of the adjacent sheet conveying rollers can be detected and the delay time can be adjusted.

After the rise time or fall time difference of the sheet conveying rollers which was displayed by the display means (display unit of the operation unit 312) was confirmed, the adjusting means (CPU 300*a*) adjusts the delay time to delay the stop or start timing of each of the adjacent sheet conveying rollers on the basis of the input delay time data. Therefore, the delay time of the stop or start of the conveyance by each sheet conveying roller can be adjusted to a desired time.

The delay start control operation of a plurality of adjacent transfer sheet conveying means in the copying apparatus of the embodiment will now be described in detail hereinbelow with reference to FIGS. 26 to 28.

Figure 26:
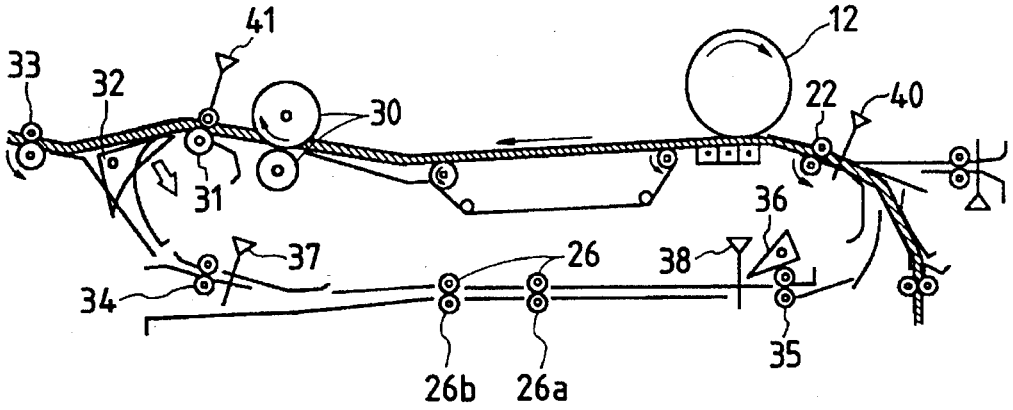
FIG. 26 is a diagram showing delay start control states of a plurality of adjacent transfer sheet conveying means in the copying apparatus.
Figure 27:
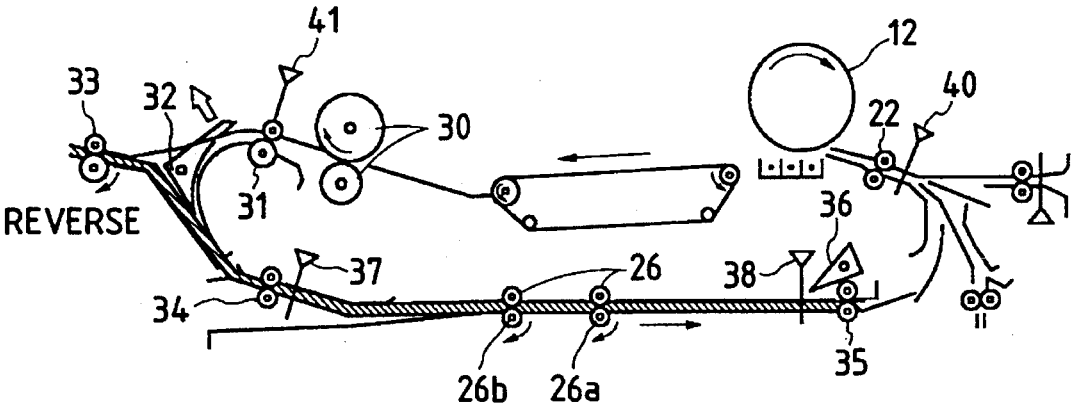
FIG. 27 is a diagram showing delay start control states of a plurality of adjacent transfer sheet conveying means in the copying apparatus.
Figure 28:
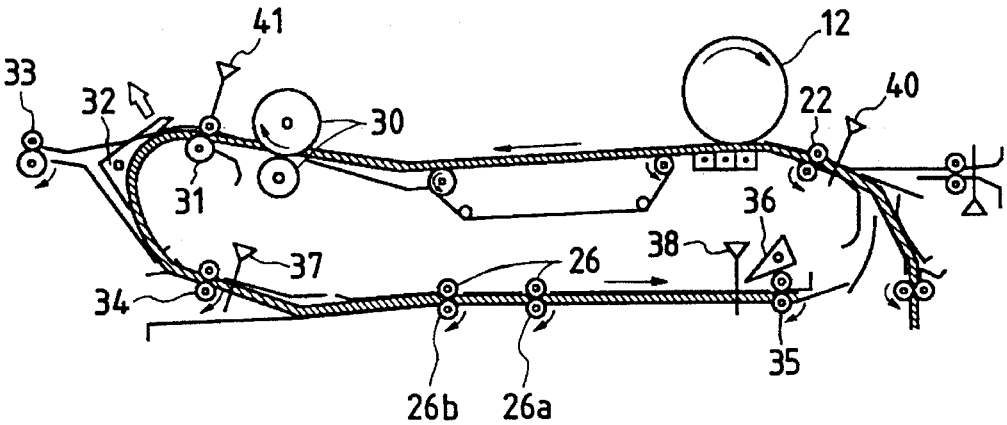
FIG. 28 is a diagram showing delay start control states of a plurality of adjacent transfer sheet conveying means in the copying apparatus.

FIGS. 26 to 28 are diagrams showing a delay start control state of a plurality of adjacent transfer sheet conveying means and the same component elements as those shown in FIGS. 3 and 1 are designated by the same reference numerals.

[When the first side of both sides is copied]

In the copying operation of the first side of both sides, the fixing roller 30, first paper delivery roller 31, inlet roller 34 of the lower conveying unit, and outlet roller 35 of the lower conveying unit are driven by the main motor 306*a* as shown in FIGS. 26 and 27. The second paper delivery roller 33 and the setback rollers 26*a* and 26*b* are driven by the other exclusive-use stepping motor 306*b*, respectively. The flapper 32 operates in the rotating direction of the second paper delivery roller 33. In the copying operation of the first side, after the elapse of a predetermined time after the rear edge of the transfer sheet on which the image had already been fixed passed through the paper delivery detecting sensor 41, the second paper delivery roller 33 is reversely rotated. In response to it, the flapper 32 is switched to the upper side. Thus, the transfer sheet is switched back and conveyed to the lower conveying unit. The sheet is stopped at the position at which the rear edge of the sheet has passed through the outlet roller 35 of the lower conveying unit by a few mm. The apparatus waits for the start of the copy of the second side.

[When the copying operation is executed at the first time in the multiplex copying mode]

In the copying operation of the first side, as shown in FIG. 28, the second paper delivery roller 33 is reversely rotated and the flapper 32 is lifted to the upper side. After completion of the copy transfer of the first time, the transfer sheet is sent to the lower conveying unit and is stopped at a position where the rear edge of the sheet passed through the outlet roller 35 of the lower conveying unit by a few min. The apparatus waits for the copy of the second time.

[In the copying mode of the second time in the both-sides (the second side) /multiplex copying mode]

The transfer sheet in the standby state in the lower conveying unit is conveyed from the state in which it is sandwiched by the outlet roller 35 (the driving force of the main motor 306*a* is transferred by the coupling of the outlet clutch 50 of the lower conveying unit) and the setback roller 26 (which is driven by the stepping motor 306*b*) which are driven by different driving sources and the transferring process of the second side or the second time is started.

The copy processing operation of the second time will now be described hereinbelow with reference to a flowchart shown in FIG. 29.

Figure 29:
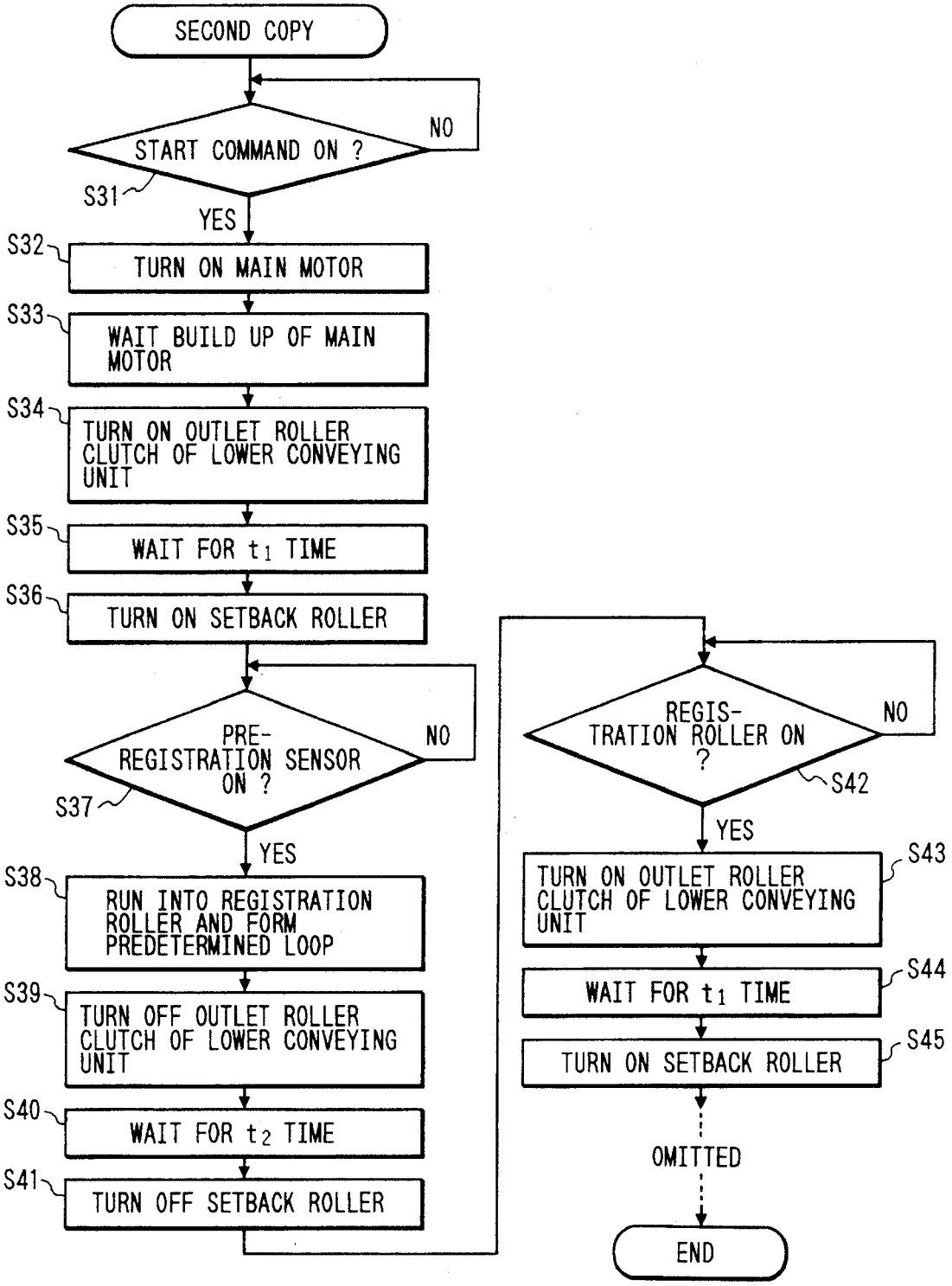
FIG. 29 is a diagram showing delay start control states of a plurality of adjacent transfer sheet conveying means in the copying apparatus.

FIG. 29 is a flowchart showing an example of a copy processing procedure of the second side which is executed by the controller 300. S31 to S45 denote processing steps.

When a starting command of the copy of the second time is generated (S31), the main motor 306*a* is driven (S32). The apparatus waits until the main motor 306*a* rises to a specified rotational speed and becomes stable (S33). The outlet clutch 50 of the lower conveying unit is coupled to the outlet roller 35 of the lower conveying unit, thereby transferring the driving force of the main motor 306*a*. The setback roller 26 is directly driven by the stepping motor 306*b*. Therefore, the rise time of the driving of each of the setback rollers 26*a* and 26*b* is earlier than the rise time of the driving of the outlet roller 35 of the lower conveying unit. Therefore, in order to allow the outlet roller 35 and the setback roller 26 to simultaneously rise, the outlet clutch 50 is first coupled, thereby driving the outlet roller 35 (S34). The apparatus waits for the elapse of the rise time difference $t_1$ of the driving of the outlet roller 35 and the setback roller 26 (S35). After the elapse of the rise time difference $t_1$, the setback rollers 26*a* and 26*b* are driven (S36). Due to this, the transfer sheet is conveyed simultaneously by both of the outlet roller 35 and the setback roller 26 and arrives at the pre-registration sheet detecting sensor 40 without being damaged. The sensor 40 waits for the detection of the transfer sheet (S37). When it detects the transfer sheet, the outlet roller 35 of the lower conveying unit is driven until the transfer sheet runs into the registration roller 22 and a loop of a predetermined amount to eliminate the oblique movement is formed (S38). After that, the rotation of the outlet roller 35 is temporarily stopped in order to match the timing of the operation of the optical system for performing an image formation (copy transfer) and the timing of the rotation of the photosensitive drum 12. In this instance, there is also a time difference between the times (fall times) which are required to stop the driving of the outlet roller 35 and the setback roller 26 in a manner similar to the rise time. The (rise) time which is required to drive the setback roller 26 is earlier than that of the outlet roller 35. Therefore, the coupling of the outlet clutch of the lower conveying unit is first cancelled (S39). The apparatus waits for the elapse of the fall time difference $t_2$ of the outlet roller 35 and the setback roller 26 (S40). After the elapse of the time difference $t_2$, the driving of the setback roller 26 is stopped (S41). After that, in order to perform the image formation (copy transfer), the transfer sheet is again conveyed. By transferring the driving force of the main motor to the registration roller 22 by the coupling of the clutch, the registration roller 22 is driven so as to match the timing of the operation of the optical system and the timing of the rotation of the photosensitive drum 12 (S42). Thus, the outlet clutch 50 is coupled simultaneously with the registration roller 22, thereby driving the outlet roller 35 (S43). After the elapse of the rise time difference t of the outlet roller 35 and the setback roller 26 (S44), the setback roller 26 is driven (S45). The subsequent transfer sheet is conveyed in a stable state and the image is copy transferred onto the transfer sheet. The sheet is subsequently delivered to the outside of the apparatus.

If the types of the clutches to transfer the driving forces to the registration roller 22 and the outlet roller 35 differ and the times which are required for coupling are different, it is also possible to control in consideration of such a time difference. Namely, the invention is not limited to the driving of two rollers but can be also applied to the driving of a plurality of rollers.

In the embodiment, in the case where the driving systems are different and the rise time of the setback rollers 26*a* and 26*b* is slower than that of the outlet roller 35 of the lower conveying unit, the setback rollers 26*a* and 26*b* are first driven and, after the elapse of the rise time difference, the outlet roller 35 of the lower conveying unit is driven.

Figure 30:
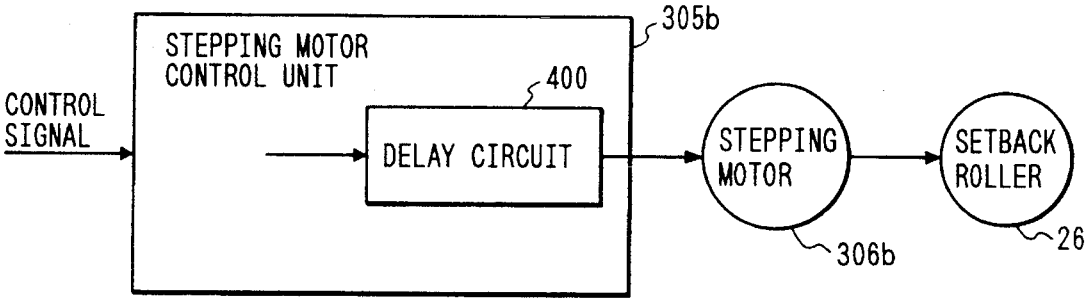
FIG. 30 is a block diagram for explaining another construction of a stepping motor control unit shown in FIG. 25.

The above embodiment has been described with respect to the case where the output timings of the driving commands to the main motor 306*a* and the stepping motor 306*b* are controlled from the CPU 300*a* and the rise time difference is caused. However, it is also possible to construct in a manner such that driving commands are simultaneously generated from the CPU 300*a* to the motor control unit 305 and the delay circuit 400 of the stepping motor control unit 305*b* delays the drive timing by the rise time difference $t_1$ and the stepping motor 306*b* is driven with the time delay $t_1$ as shown in FIG. 30. A similar effect can be also expected by such a construction.

Specifically, in case of conveying the transfer sheet sandwiched by the outlet roller 35 and the setback roller 26, the outlet clutch 50 of the lower conveying unit is coupled and the stepping motor 306*b* is simultaneously driven. Therefore, a stepping motor drive control signal is delayed by the time difference $t_1$ by the delay circuit 400 and drives the stepping motor 306*b*. Therefore, the outlet roller 35 and the setback roller 26 almost simultaneously rise and rotate and convey the transfer sheet. Although the time difference $t_1$ is set into the delay circuit 400 as a fixed delay time which is previously set on the basis of the analysis result of the experimental data, the time difference $t_1$ can be also varied by the input from the operation unit.

In the case where the transfer sheet during the conveyance is sandwiched by the outlet roller 35 and the setback rollers 26*a* and 26*b* and is stopped, when it is now assumed that the rise time difference $t_1$=fall time difference $t_2$, the coupling of the outlet clutch 50 is cancelled and the driving of the stepping motor 306*b* is simultaneously stopped. Therefore, the stepping motor driving step control signal is delayed by the delay circuit 400 by the time $t_2$ ($=t_1$) due to the actual stop of the driving of the stepping motor 306*b*. Therefore, the outlet roller 35 and the setback roller 26 are almost simultaneously stopped and the transfer sheet is stopped. When the rise time difference $t_1 \neq$ the fall time difference $t_2$, it is sufficient to construct in a manner such that delays of the control signals of the rise time difference $t_1$ and the fall time difference $t_2$ are caused in the delay circuit 400 by switching means for switching between the driving mode and the drive stopping mode.

The above embodiment has been described with respect to the case of driving the stepping motor 306*b* at the timings corresponding to the rise time difference $t_1$ and the fall time difference $t_2$ by the CPU 300*a*, delay circuit 400, and the like. However, it is also possible to construct in a manner such that the rise times or fall times of the outlet roller 35 and the setback roller 26 are counted by the count means 60 and 61 shown in FIG. 25 and the rise time difference $t_2$ and the fall time difference $t_2$ are determined from those difference times.

In the count means 60 and 61, encoders are provided for the axes of the corresponding outlet roller 35 and setback rollers 26*a* and 26*b* and detection signals from detecting means such as photointerrupters or the like for detecting rotating states of the encoders are monitored by the controller 300. The time which is required until the detection signal is set to a predetermined period from the driving command assumes the rise time. The time which is required until the detection signal is set to a predetermined level from the drive stopping command assumes the fall time. Those rise time and fall time are counted, respectively.

A difference between the time counted by the count means 60 and the time counted by the count means 61 is obtained and such a difference value is stored and held in the RAM 300*c*. The rise time difference is stored and held in the RAM region of $t_1$. The fall time difference is stored and held in the RAM region of $t_2$. The driving control is executed by using the values of $t_1$ and $t_2$ in the control of the next time.

Consequently, even if the rise and fall times of several rollers comprising different driving means change due to a difference between machines, a difference of the circumstances, an aging change, or the like, the always stable driving (transfer sheet conveying) control can be held.

The above embodiment has been described with respect to the case of providing the count means 60 and 61 for the outlet roller 35 and setback rollers 26*a* and 26*b*, respectively. However, it is also possible to construct in a manner such that the rise time and fall time of each roller is counted by one count means so as to count a relative count value of each roller. Further, it is also possible to construct in a manner such that the count values of the fall time and rise time are monitored every time and the feedback control is not executed but, for example, when the power source is turned on, the count values are obtained at the first time and, after that, the same count values are used and fed back. On the other hand, it is also possible to use a construction such that an optimum value is calculated by executing a data process such that the mean value of the count values which are obtained by counting several times or the like and the delay time is determined on the basis of the calculated optimum count value.

Figure 31:
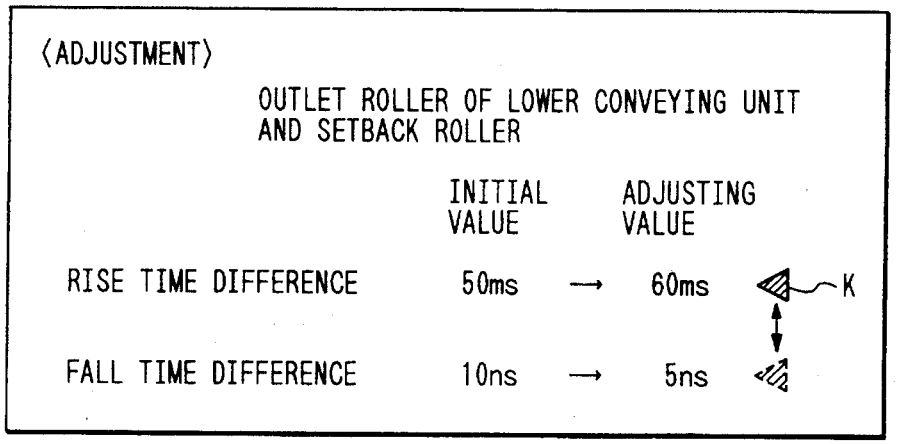
FIG. 31 is a schematic diagram showing a third adjustment value display example on the operation unit shown in FIG. 2.

As shown in FIG. 31, further, it is also possible to construct in a manner such that the rise and fall time differences of the rollers comprising different driving means are displayed as present (initial) values onto the screen of the operation unit 312, those values are adjusted by adjusting means, and the adjustment values are also displayed onto the screen of the operation unit 312 in parallel with those initial values, thereby making it possible to cope with the difference between the machines, difference of the circumstances, and aging change.

Specifically, data is displayed on the screen as shown in FIG. 31 and the service person directly observes the image of the machine installation environment and transfer sheet and inputs adjustment values and adjusts them, thereby making it possible to set into a state in which the optimum transfer sheet conveyance can be performed. As an adjustment in this case, the values are adjusted by the operation unit 312 in FIG. 2, the adjusted items are selected by moving the cursor K by the cursor key or the like, and the adjustment value for the selected item is input from the ten-key or the like. In the case where the image forming apparatus has communicating means corresponding to the network, it is also possible to monitor the adjustment value from a host computer at a remote location and to perform the adjustment.

Although the embodiment has been described with respect to the copying apparatus, the invention can be also applied to a printing apparatus or the like.

Although the embodiment has been described with respect to the electrophotographing system, the invention can be also applied to an ink jet system or the like.

According to the first invention as described above, when the sheet detecting means detects the front edge of the transfer sheet which is conveyed by the sheet conveying rollers, the loop forming means controls the run-into conveyance amount from the detecting position of the front edge of the transfer sheet and forms a loop of a variable amount. The setback control means controls the forward or reverse rotation of each sheet conveying roller and the transfer sheet which was run into the paper-conveying roller having such a loop is stacked and enclosed onto a predetermined conveying path at a predetermined interval. Therefore, the stacking and enclosing interval of each transfer sheet can be set to a constant value in a manner such that the transfer sheets can be certainly separated and again fed even if the number of transfer sheets which are conveyed is increased or decreased.

On the other hand, the loop forming means forms the loop of the variable amount according to the loop data selected from the memory means on the basis of the set transfer sheet conveying conditions and the sheet detection output state of the sheet detecting means. Therefore, the loop of the optimum variable amount adapted to the individual transfer sheet conveying conditions can be formed.

Further, since the loop forming means variably changes the run-into conveyance amount of each transfer sheet for every number of transfer sheets which are stacked onto a predetermined conveying path, the loop of the optimum variable amount for every number of sheets can be formed.

Since the loop forming means decreases the run-into conveyance amount of each transfer sheet each time the number of transfer sheets which are stacked onto a predetermined conveying path increases, the stacking and enclosing interval of each transfer sheet can be set to a constant value so that the transfer sheets can be certainly separated and again fed.

Further, since the loop forming means variably changes the run-into conveyance amount of each transfer sheet on the basis of the image forming mode for the transfer sheets which are stacked onto a predetermined conveying path, even if a curl occurs in the transfer sheet in the vertical direction, the stacking and enclosing interval of each transfer sheet can be set to a constant value so that the transfer sheets can be certainly separated and again fed.

Even when the conveying fraction defective of every number of stacked transfer sheets increases, the correcting means automatically corrects the run-into conveyance amount of each transfer sheet for every number of stacked transfer sheets on the basis of the count value counted by the first count means. Therefore, the stacking and enclosing interval of each transfer sheet can be set into a constant value in a manner such that the transfer sheets can be certainly separated and again fed even if an aging change of the abrasion of the sheet conveying roller occurs.

Further, desired adjustment data is input and the run-into conveyance amount is adjusted while checking the count value counted by the first count means and the run-into conveyance amount for every number of stacked transfer sheets which are displayed on the first display means. Therefore, the loop of the variable amount according to the aging change of the abrasion of the sheet conveying rollers can be formed.

According to the second invention, in the case where the conveyance of the transfer sheet is stopped or started in a state in which the sheet is sandwiched by both of the adjacent sheet conveying rollers of different driving sources, the timing control means delays the stop or start timing of the adjacent sheet conveying rollers. Therefore, even if the transfer sheet is stopped in a state in which the sheet is sandwiched by the adjacent sheet conveying rollers, the conveyance of the transfer sheet sandwiched by the sheet conveying rollers can be smoothly started or stopped.

Further, since the timing control means delays the stop or start timing of each of the adjacent sheet conveying rollers on the basis of the counting state of the software timer, the delay amount can be freely changed.

Since the timing control means delays the stop or start timing of each of the adjacent sheet conveying rollers on the basis of the output of the delay circuit, it can be always delayed at an accurate timing.

Further, in case of stopping or starting the conveyance of the transfer sheet in a state in which the sheet is sandwiched by the adjacent sheet conveying rollers of different driving sources, the timing control means delays the stop or start timing of each of the adjacent sheet conveying rollers on the basis of the rise or fall time difference of each of the adjacent sheet conveying rollers which was counted by the count means. Therefore, the rise or fall time difference of each of the present sheet conveying rollers is detected and the delay time can be adjusted.

After the rise or fall time difference of each sheet conveying roller displayed on the display means was confirmed, the adjusting means adjusts the delay time to delay the stop or start timing of each of the adjacent sheet conveying rollers on the basis of the input delay time data. Therefore, the delay time of the stop or start of the conveyance by each sheet conveying roller can be adjusted to a desired time.

Therefore, the transfer sheet on which the image was once transferred by the transfer unit can be again conveyed to the transfer unit in a stable state.

What is claimed is:

1. An image forming apparatus comprising:

image forming means for forming an image onto a sheet which is conveyed;

first and second conveying means for again conveying the sheet from said image forming means to said image forming means, said second conveying means stopping a first one of the sheets conveyed by said first conveying means at a first predetermined position and, after a second one of the sheets which is conveyed subsequently to the first sheet by said first conveying means is conveyed to a second predetermined position on the first sheet, said second conveying means conveying the first and second sheets in a partially overlapped state and separating the first sheet and supplying the separated first sheet to said image forming means; and detecting means, positioned at a first distance from said second conveying means, for detecting a front edge of a sheet which is conveyed to said first conveying means, wherein, in a state where said first conveying means is conveying the first sheet and said second conveying means is stopped, after the first sheet is conveyed by said first conveying means by a first predetermined amount after the front edge of the first sheet has been detected by said detecting means, the first predetermined amount being larger than the first distance, said second conveying means conveys the first sheet and stops the first sheet at the first predetermined position, and wherein, in a state where said first conveying means is conveying the second sheet and said second conveying means is stopped, after the second sheet is conveyed by said first conveying means by a second predetermined amount after the front edge of the second sheet has been detected by said detecting means, the second predetermined amount being larger than the first distance and being different from the first predetermined amount, said second conveying means conveys the first and second sheets.

2. An apparatus according to claim 1, wherein said first predetermined amount is larger than said second predetermined amount.

3. An apparatus according to claim 1, wherein said detecting means is located between said first and second conveying means.

4. An apparatus according to claim 1, wherein said first and second conveying means are a pair of rollers.

5. An image forming apparatus comprising:

image forming means for forming an image onto a sheet which is conveyed;

first and second conveying means for again conveying the sheet from said image forming means to said image forming means, said second conveying means stopping a first one of the sheets conveyed by said first conveying means at a predetermined position and, after a second one of the sheets which is conveyed subsequently to the first sheet by said first conveying means is conveyed to a predetermined position on the first sheet, said second conveying means conveying said first and second sheets in a partially overlapped state and separating the first sheet and supplying the separated first sheet to said image forming means;

reversing means for reversing the front and back sides of the sheet from said image forming means and for supplying the reversed sheet to said first conveying means; and detecting means for detecting a front edge of a sheet which is conveyed to said first conveying means, wherein in a case where the sheet from said image forming means is supplied to said first conveying means without passing through said reversing means, said second conveying means conveys said sheet after the sheet is conveyed by said first conveying means by a first predetermined amount after the front edge of the sheet has been detected by said detecting means, and wherein in a case where the sheet from said image forming means is supplied to said first conveying means through said reversing means, said second conveying means conveys said sheet after the sheet is conveyed by said first conveying means by a second predetermined amount different from said first predetermined amount after the front edge of the sheet has been detected by said detecting means.

6. An apparatus according to claim 5, wherein said first predetermined amount is larger than said second predetermined amount.

7. An apparatus according to claim 5, wherein said detecting means is located between said first and second conveying means.

8. An apparatus according to claim 5, wherein said first and second conveying means are a pair of rollers.

9. An apparatus according to claim 5, wherein said first and second predetermined amounts are larger than a distance between said detecting means and said second conveying means.

10. An apparatus according to claim 5, wherein said image forming means forms the image by an electrophotographing process.

11. An image forming apparatus comprising:

image forming means for forming an image onto a sheet which is conveyed;

first and second conveying means for again conveying the sheet from said image forming means to said image forming means, in which said second conveying means stops a first one of the sheets conveyed by said first conveying means at a predetermined position and, after a second one of the sheets which is conveyed subsequently to the first sheet by said first conveying means is conveyed to a predetermined position on the first sheet, said second conveying means conveys the first and second sheets in a partially overlapped state and separates the first sheet and supplies the separated first sheet to said image forming means; and detecting means for detecting a front edge of a sheet which is conveyed by said first conveying means, wherein in a state where said first conveying means conveys the first sheet and said second conveying means is stopped, after the first sheet is conveyed by said first conveying means by a variable amount larger than a distance between said detecting means and said second conveying means after the front edge of the sheet had been detected by said detecting means, said second conveying means conveys the first sheet.

12. An apparatus according to claim 11, further having abnormality detecting means for detecting a defective conveyance of the sheet, and wherein said second conveying means changes said predetermined amount in accordance with the result of the detection of said abnormality detecting means.

13. An apparatus according to claim 12, wherein said abnormality detecting means detects the number of defective conveyance times of the sheet.

14. An apparatus according to claim 12, wherein said abnormality detecting means detects a rate of occurrence of the defective conveyance of the sheet.

15. An apparatus according to claim 11, further having adjusting means for adjusting said predetermined amount.

16. An image forming apparatus comprising:

a plurality of sheet conveying rollers which are forwardly or reversedly rotatable, thereby conveying a transfer sheet forwardly or backwardly;

sheet detecting means for detecting a front edge of each transfer sheet which is sequentially conveyed on a predetermined conveying path;

loop forming means for forming a loop of a variable amount by controlling a run-into conveyance amount of each transfer sheet which is run into and conveyed to a stopped one of the plurality of sheet conveying rollers on the basis of a sheet detection output state of said sheet detecting means; and setback control means for controlling forward or reverse rotation of said plurality of sheet conveying rollers, for executing a setback operation to forwardly or backwardly move a transfer sheet in which a loop was formed by said loop forming means, and for stacking and enclosing each transfer sheet onto said predetermined conveying path at a predetermined interval.

17. An apparatus according to claim 16, further having memory means for storing loop data of a variable amount based on transfer sheet conveying conditions, wherein said loop forming means forms the loop of the variable amount according to the loop data selected from said memory means on the basis of the set transfer sheet conveying conditions and the sheet detection output state of the sheet detecting means.

18. An apparatus according to claim 16, wherein said loop forming means variably changes a run-into conveyance amount of each transfer sheet for every number of transfer sheets which are stacked onto the predetermined conveying path.

19. An apparatus according to claim 16, wherein said loop forming means reduces a run-into conveyance amount of each transfer sheet each time the number of transfer sheets which are stacked onto the predetermined conveying path increases.

20. An apparatus according to claim 16, wherein said loop forming means variably changes a run-into conveyance amount of each transfer sheet on the basis of an image forming mode for the transfer sheets which are stacked onto the predetermined conveying path.

21. An apparatus according to claim 16, further having:

first count means for counting the number of defective conveyance times for every number of stacked transfer sheets; and first correcting means for automatically correcting a run-into conveyance amount of each transfer sheet for every number of stacked transfer sheets on the basis of a count value counted by said first counting means.

22. An apparatus according to claim 16, further having:

first count means for counting the number of defective conveyance times for every number of stacked transfer sheets;

first display means for displaying a count value counted by said first counting means and the run-into conveyance amount for every number of stacked transfer sheets; and first adjusting means for adjusting the run-into conveyance amount on the basis of the adjustment data inputted on the basis of the count value displayed on said first display means.

23. An apparatus according to claim 16, wherein said setback control means stacks in plural stacking states in accordance with plural different image forming modes, and further having:

first count means for counting the number of defective conveyance times of each of the plural stacking states of the transfer sheets; and first correcting means for automatically correcting the run-into conveyance amount of each transfer sheet of each of the plural image forming modes on the basis of a count value counted by said first counting means.

24. An apparatus according to claim 16, wherein said setback control means stacks in plural stacking states in accordance with plural different image forming modes, and further having:

first counting means for counting the number of defective conveyance times of the plural stacking states of the transfer sheets;

first display means for displaying a count value counted by said first counting means and a run-into conveyance amount of each of the plural image forming modes of the transfer sheets; and first adjusting means for adjusting the run-into conveyance amount on the basis of the adjustment data inputted on the basis of the count value displayed on said first display means.

25. An image forming apparatus comprising:.

a plurality of sheet conveying rollers which are forwardly or reversedly rotatable by different driving sources so as to convey a transfer sheet forwardly or backwardly;

timing control means for delaying a stop or start timing of each adjacent sheet conveying rollers in a case where conveyance of the transfer sheet is stopped or started in a state in which the transfer sheet is sandwiched by both of the adjacent sheet conveying rollers of different driving sources; and count means for counting a rise or fall time of each of the adjacent sheet conveying rollers which are driven by different driving sources, wherein in case of stopping or starting the conveyance of the transfer sheet in a state in which the sheet is sandwiched by both of the adjacent sheet conveying rollers of the different driving sources, said timing control means delays the stop or start timing of each of the adjacent sheet conveying rollers on the basis of a difference of the rise or fall times of the adjacent sheet conveying rollers which were counted by said count means.

26. An apparatus according to claim 25, further having:

display means for displaying a difference of the rise or fall times of the adjacent sheet conveying rollers which were counted by said count means; and adjusting means for adjusting a delay time to delay the stop or start timing of each of the adjacent sheet conveying rollers on the basis of delay time data which is inputted.

27. An image forming apparatus comprising:

image forming means for forming an image onto a sheet which is conveyed;

first and second conveying means for again conveying the sheet from said image forming means to said image forming means, in which said second conveying means stops first one of the sheets conveyed by said first conveying means at a predetermined position and, after second one of the sheets which is conveyed subsequently to said first sheet by said first conveying means was conveyed to a predetermined position on said first sheet, said second conveying means conveys the first and second sheets in a partially overlapped state and separates the first sheet and supplies the separated first sheet to said image forming means;

detecting means for detecting a front edge of the sheet which is conveyed by said first conveying means; and abnormality detecting means for detecting a defective conveyance of the sheet, wherein said second conveying means conveys the sheet after the sheet was conveyed by said first conveying means by a predetermined variable amount after the front edge of the sheet had been detected by said detecting means, and wherein said second conveying means changes said predetermined amount in accordance with the result of the detection of said abnormality.

28. An apparatus according to claim 27, wherein said abnormality detecting means detects the number of defective conveyance times of the sheet.

29. An apparatus according to claim 27, wherein said abnormality detecting means detects a rate of occurrence of the defective conveyance of the sheet.

* * * * *